US005672856A

United States Patent [19]

Kolb et al.

[11] Patent Number: 5,672,856

[45] Date of Patent: Sep. 30, 1997

[54] TILT SWITCH WITH INCREASED ANGULAR RANGE OF CONDUCTION AND ENHANCED DIFFERENTIAL CHARACTERISTICS

[75] Inventors: Edgar C. Kolb, Freeport; James S. Robinson, Freeport, both of Ill.

[73] Assignee: Honeywell Inc., Minneapolis, Minn.

[21] Appl. No.: 552,181

[22] Filed: Nov. 2, 1995

[51] Int. Cl.[6] ..... H01H 35/02; H01H 35/14

[52] U.S. Cl. ..... 200/61.52; 200/61.45 R

[58] Field of Search ..... 200/61.52, 61.45 R, 200/DIG. 29

[56] References Cited

U.S. PATENT DOCUMENTS

| | | | |
|---|---|---|---|
| 3,831,163 | 8/1974 | Byers | 340/262 |
| 3,963,888 | 6/1976 | Riede | 200/61.48 |
| 4,135,067 | 1/1979 | Bitko | 200/61.52 |
| 4,628,160 | 12/1986 | Canevari | 200/61.45 R |
| 5,136,126 | 8/1992 | Blair | 200/61.52 |
| 5,136,127 | 8/1992 | Blair | 200/61.52 |
| 5,155,308 | 10/1992 | Blair | 200/61.52 |
| 5,504,287 | 4/1996 | Cable | 200/61.52 |

*Primary Examiner*—Adolf Berhane
*Attorney, Agent, or Firm*—William D. Lanyi

[57] ABSTRACT

A tilt switch is made by attaching two electrically conductive members to a nonconducting tube and disposing a conductive sphere within the switch. The first and second electrically conductive members are provided with inner cylindrical surfaces of different diameters in order to create an asymmetry that allows the angular conducting range of the switch to be increased without increasing its differential angle at one limit of travel. The first and second electrically conductive members that are used as the end caps of the switch are provided with inner cylindrical surfaces of different diameters. When the conductive sphere is disposed within the switch, it can assume three different positions in relation to the first and second electrically conductive members. A first position is defined by the sphere being in contact with both electrically conductive members and supported by contact points of both members. The second position is defined by the sphere being in contact with a first contact point but in noncontact relation with a second contact point. The third position is defined by the sphere being in contact with the second contact point but being in noncontact relation with the first contact point.

18 Claims, 17 Drawing Sheets

| R | L | G | X | D | ø1+ø2 | øD | ø1 | ø2 | ø3 | ø4 | ø5 | ø | M | N |
|---|---|---|---|---|---|---|---|---|---|---|---|---|---|---|
| 0.1250 | 0.1200 | 0.1120 | 0.1120 | 0.000 | 53.231 | 24.323 | 26.615 | 26.615 | 26.615 | 26.615 | 2.292 | 0.000 | 0.056 | 0.056 |
| 0.1250 | 0.1200 | 0.1120 | 0.1121 | 0.004 | 53.267 | 22.296 | 26.634 | 26.634 | 24.588 | 28.679 | 2.292 | 2.045 | 0.052 | 0.060 |
| 0.1250 | 0.1200 | 0.1120 | 0.1123 | 0.008 | 53.377 | 20.311 | 26.689 | 26.689 | 22.603 | 30.774 | 2.292 | 4.086 | 0.048 | 0.064 |
| 0.1250 | 0.1200 | 0.1120 | 0.1126 | 0.012 | 53.560 | 18.372 | 26.780 | 26.780 | 20.664 | 32.895 | 2.292 | 6.116 | 0.044 | 0.068 |
| 0.1250 | 0.1200 | 0.1120 | 0.1131 | 0.016 | 53.815 | 16.485 | 26.907 | 26.907 | 18.777 | 35.037 | 2.292 | 8.130 | 0.040 | 0.072 |
| 0.1250 | 0.1200 | 0.1120 | 0.1138 | 0.020 | 54.141 | 14.653 | 27.071 | 27.071 | 16.946 | 37.195 | 2.292 | 10.125 | 0.036 | 0.076 |
| 0.1250 | 0.1200 | 0.1120 | 0.1145 | 0.024 | 54.538 | 12.882 | 27.269 | 27.269 | 15.174 | 39.364 | 2.292 | 12.095 | 0.033 | 0.079 |
| 0.1250 | 0.1200 | 0.1120 | 0.1154 | 0.028 | 55.005 | 11.174 | 27.503 | 27.503 | 13.466 | 41.539 | 2.292 | 14.036 | 0.029 | 0.083 |
| 0.1250 | 0.1200 | 0.1120 | 0.1165 | 0.032 | 55.540 | 9.532 | 27.770 | 27.770 | 11.825 | 43.716 | 2.292 | 15.945 | 0.026 | 0.086 |
| 0.1250 | 0.1200 | 0.1120 | 0.1176 | 0.036 | 56.143 | 7.960 | 28.072 | 28.072 | 10.253 | 45.890 | 2.292 | 17.819 | 0.022 | 0.090 |
| 0.1250 | 0.1200 | 0.1120 | 0.1189 | 0.040 | 56.812 | 6.460 | 28.406 | 28.406 | 8.752 | 48.060 | 2.292 | 19.654 | 0.019 | 0.093 |
| 0.1250 | 0.1200 | 0.1120 | 0.1203 | 0.044 | 57.545 | 5.032 | 28.772 | 28.772 | 7.325 | 50.220 | 2.292 | 21.448 | 0.016 | 0.096 |
| 0.1250 | 0.1200 | 0.1120 | 0.1219 | 0.048 | 58.341 | 3.679 | 29.170 | 29.170 | 5.972 | 52.369 | 2.292 | 23.199 | 0.013 | 0.099 |
| 0.1250 | 0.1200 | 0.1120 | 0.1235 | 0.052 | 59.199 | 2.402 | 29.599 | 29.599 | 4.695 | 54.504 | 2.292 | 24.905 | 0.010 | 0.102 |
| 0.1250 | 0.1200 | 0.1120 | 0.1252 | 0.056 | 60.116 | 1.201 | 30.058 | 30.058 | 3.493 | 56.623 | 2.292 | 26.565 | 0.008 | 0.104 |
| 0.1250 | 0.1200 | 0.1120 | 0.1271 | 0.060 | 61.093 | 0.075 | 30.546 | 30.546 | 2.368 | 58.725 | 2.292 | 28.179 | 0.005 | 0.107 |

*Fig. 15*

| R | L | X | D | G | G1+ø2 | øD | ø1 | ø2 | ø3 | ø4 | ø5 | ø | M | N |
|---|---|---|---|---|---|---|---|---|---|---|---|---|---|---|
| 0.125 | 0.120 | 0.112 | 0 | 0.112 | 53.231 | 24.323 | 26.615 | 26.615 | 26.615 | 26.615 | 2.292 | 0 | 0.056 | 0.056 |
| 0.125 | 0.120 | 0.116 | 0 | 0.116 | 55.291 | 25.353 | 27.646 | 27.646 | 27.646 | 27.646 | 2.292 | 0 | 0.058 | 0.058 |
| 0.125 | 0.120 | 0.120 | 0 | 0.120 | 57.371 | 26.393 | 28.685 | 28.685 | 28.685 | 28.685 | 2.292 | 0 | 0.060 | 0.060 |
| 0.125 | 0.120 | 0.124 | 0 | 0.124 | 59.471 | 27.443 | 29.736 | 29.736 | 29.736 | 29.736 | 2.292 | 0 | 0.062 | 0.062 |
| 0.125 | 0.120 | 0.128 | 0 | 0.128 | 61.594 | 28.505 | 30.797 | 30.797 | 30.797 | 30.797 | 2.292 | 0 | 0.064 | 0.064 |
| 0.125 | 0.120 | 0.132 | 0 | 0.132 | 63.741 | 29.578 | 31.870 | 31.870 | 31.870 | 31.870 | 2.292 | 0 | 0.066 | 0.066 |
| 0.125 | 0.120 | 0.136 | 0 | 0.136 | 65.913 | 30.664 | 32.956 | 32.956 | 32.956 | 32.956 | 2.292 | 0 | 0.068 | 0.068 |
| 0.125 | 0.120 | 0.140 | 0 | 0.140 | 68.112 | 31.763 | 34.056 | 34.056 | 34.056 | 34.056 | 2.292 | 0 | 0.070 | 0.070 |
| 0.125 | 0.120 | 0.144 | 0 | 0.144 | 70.339 | 32.877 | 35.170 | 35.170 | 35.170 | 35.170 | 2.292 | 0 | 0.072 | 0.072 |
| 0.125 | 0.120 | 0.148 | 0 | 0.148 | 72.598 | 34.007 | 36.299 | 36.299 | 36.299 | 36.299 | 2.292 | 0 | 0.074 | 0.074 |
| 0.125 | 0.120 | 0.152 | 0 | 0.152 | 74.890 | 35.153 | 37.445 | 37.445 | 37.445 | 37.445 | 2.292 | 0 | 0.076 | 0.076 |
| 0.125 | 0.120 | 0.156 | 0 | 0.156 | 77.218 | 36.316 | 38.609 | 38.609 | 38.609 | 38.609 | 2.292 | 0 | 0.078 | 0.078 |
| 0.125 | 0.120 | 0.160 | 0 | 0.160 | 79.584 | 37.499 | 39.792 | 39.792 | 39.792 | 39.792 | 2.292 | 0 | 0.080 | 0.080 |
| 0.125 | 0.120 | 0.164 | 0 | 0.164 | 81.991 | 38.703 | 40.996 | 40.996 | 40.996 | 40.996 | 2.292 | 0 | 0.082 | 0.082 |
| 0.125 | 0.120 | 0.168 | 0 | 0.168 | 84.443 | 39.929 | 42.222 | 42.222 | 42.222 | 42.222 | 2.292 | 0 | 0.084 | 0.084 |
| 0.125 | 0.120 | 0.172 | 0 | 0.172 | 86.944 | 41.180 | 43.472 | 43.472 | 43.472 | 43.472 | 2.292 | 0 | 0.086 | 0.086 |

*Fig. 16*

TILT SWITCH WITH INCREASED ANGULAR RANGE OF CONDUCTION AND ENHANCED DIFFERENTIAL CHARACTERISTICS

BACKGROUND OF THE INVENTION

1. Field of the Invention:

The present invention is generally related to tilt switches and, more particularly, to a tilt switch that allows its angular range of conduction to be increased without an adverse effect on the differential operational characteristics of the switch.

2. Description of the Prior Art:

Many different types of tilt switches are well known to those skilled in the art. Certain tilt switches use mercury within a sealed capsule. This type of tilt switch has been widely used in thermostats. Mercury is also used in tilt switches that are associated with sump pumps and other mechanisms that require electrical contact to be made in response to a predetermined angular position of some movable member.

One particularly advantageous tilt switch is described in U.S. Pat. No. 5,136,127. The tilt actuated switch described in this patent incorporates first and second conductive end caps that are disposed apart from each other by a predetermined distance in order to define a gap between the inwardly directed end faces of the end caps. A nonconductive member is used to provide the appropriate spacing of the first and second end caps and a conductive sphere is disposed between the end caps in the region of the predefined gap. The sphere is supported by first and second support contact points, or edges, at the interfaces between cylindrical surfaces of the generally tubular end caps and the end faces of the end caps which are arranged to face each other. When the switch is generally horizontal, the sphere bridges the gap between the support contact points and provides electrical continuity between the first and second end caps. When the switch is tilted, the sphere moves out of contact with one of the support contact points and breaks the electrical communication between the end caps. The movement of the sphere from a first position to a second position is accomplished by the sphere pivoting about one of the support contact points. During normal operation, the sphere does not roll within the switch and therefore is not susceptible to many of the problems associated with tilt switches that utilize rolling spheres.

As will be described in greater detail below, the tilt switch described in U.S. Pat. No. 5,136,127 provides an angular range of conduction, defined by the sphere being in contact with both support contact points, or edges, of the end caps, which is determined by the gap between the end faces of the two end caps. Of course, the diameter of the sphere could also be changed to cause the angular range of conduction to change, but a change in the size of the sphere would also change its weight and the resulting contact forces that the sphere can provide. However, if a sphere of a certain diameter is required, the tilt switch described in U.S. Pat. No. 5,136,127 can change the angular range of conduction only by increasing or decreasing the magnitude of the gap between the end faces of the end caps.

In certain applications, it is necessary to expand the angular range of conduction where the sphere is in electrical contact with both end caps to complete an electrical circuit. If the gap between the end caps is increased to achieve the increased angular range of conduction, other characteristics of the switch are also changed. Unfortunately, the differential characteristic of the switch is changed in a disadvantageous way for certain applications when the gap is increased between the end faces of the end caps. It would therefore be significantly beneficial if a tilt switch can be made in such a way that the angular range of conduction can be increased without a deleterious change in the differential characteristics of the switch.

SUMMARY OF THE INVENTION

A tilt switch made in accordance with the principles of the present invention provides asymmetry in relation to the position of a conductive sphere relative to first and second edges of first and second electrically conductive members. The asymmetry allows the switch to be altered in order to increase the angular range of conduction without adversely affecting the differential characteristics of the switch.

In a particularly preferred embodiment of the present invention, a tilt switch is provided with a first electrically conductive member having a first contact point defined by the intersection of two surfaces of the first electrically conductive member. A second electrically conductive member having a second contact point defined by the intersection of two surfaces of the second electrically conductive member is also provided. The first and second electrically conductive members are aligned on a common axis. A means is provided for supporting the first and second electrically conductive members in nonconducting relation with each other. An electrically conductive sphere is disposable in contact with the first and second edges of the first and second electrically conductive members and is movable, in response to movement of the common axis relative to a horizontal reference, between a first position and a second position. The first position is defined by the electrically conductive sphere being in contact with the first and second edges and the second position is defined by the electrically conductive sphere being in contact with the first edge and in noncontact relation with the second edge. The common axis is spaced farther from the first edge than from the second edge.

In a particularly preferred embodiment of the present invention, the tilt switch further comprises a source of electrical power and an electric lamp. The first and second electrically conductive members of the tilt switch are connected serially in electrical communication with the source of electrical power and with the lamp.

In one application of the present invention, the tilt switch is used in association with a hood member of a transportation vehicle, such as an automobile, a truck or van. In this type of application, the lamp is attached to the hood member along with the tilt switch.

In a particularly preferred embodiment of the present invention, the first and second electrically conductive members are generally cylindrical and arranged to be concentric with each other and with the common axis. The supporting means can comprise a plastic tube connected between the first and second electrically conductive members.

In certain embodiments of the present invention, the electrically conductive sphere is also movable in response to a second movement of the common axis relative to the horizontal reference between first and third positions. The first position, as described above, is defined by the electrically conductive sphere being in contact relation with the first and second contact points. The third position is defined by the electrically conductive sphere being in contact relation with the second contact point and in noncontact relation with the first contact point.

In a particularly preferred embodiment of the present invention, the characteristic of the switch, wherein the common axis is spaced further from the first contact point than from the second contact point, is achieved by providing the first and second electrically conductive members with inner diameters that are of different magnitudes. For example, the inner diameter of the cylindrical first electrically conductive member can be larger than that of the second electrically conductive member. This places the centerline of the two cylinders at different distances from the inner cylindrical surfaces of the electrically conductive members and, as a result, places the common axis at a greater distance from the first contact point than from the second contact point.

BRIEF DESCRIPTION OF THE DRAWINGS

The present invention will be more fully and completely understood from a reading of the Description of the Preferred Embodiment in conjunction with the drawings, in which:

FIG. 15 shows a table of values calculated as a function of various magnitudes of difference between the diameters of the inner cylindrical surfaces of the first and second electrically conductive members of the present invention;

FIG. 16 shows various angular and linear relationships resulting from modifications of known switches by increasing the gap G between the end faces of opposing end caps;

DESCRIPTION OF THE PREFERRED EMBODIMENT

Figure 1:
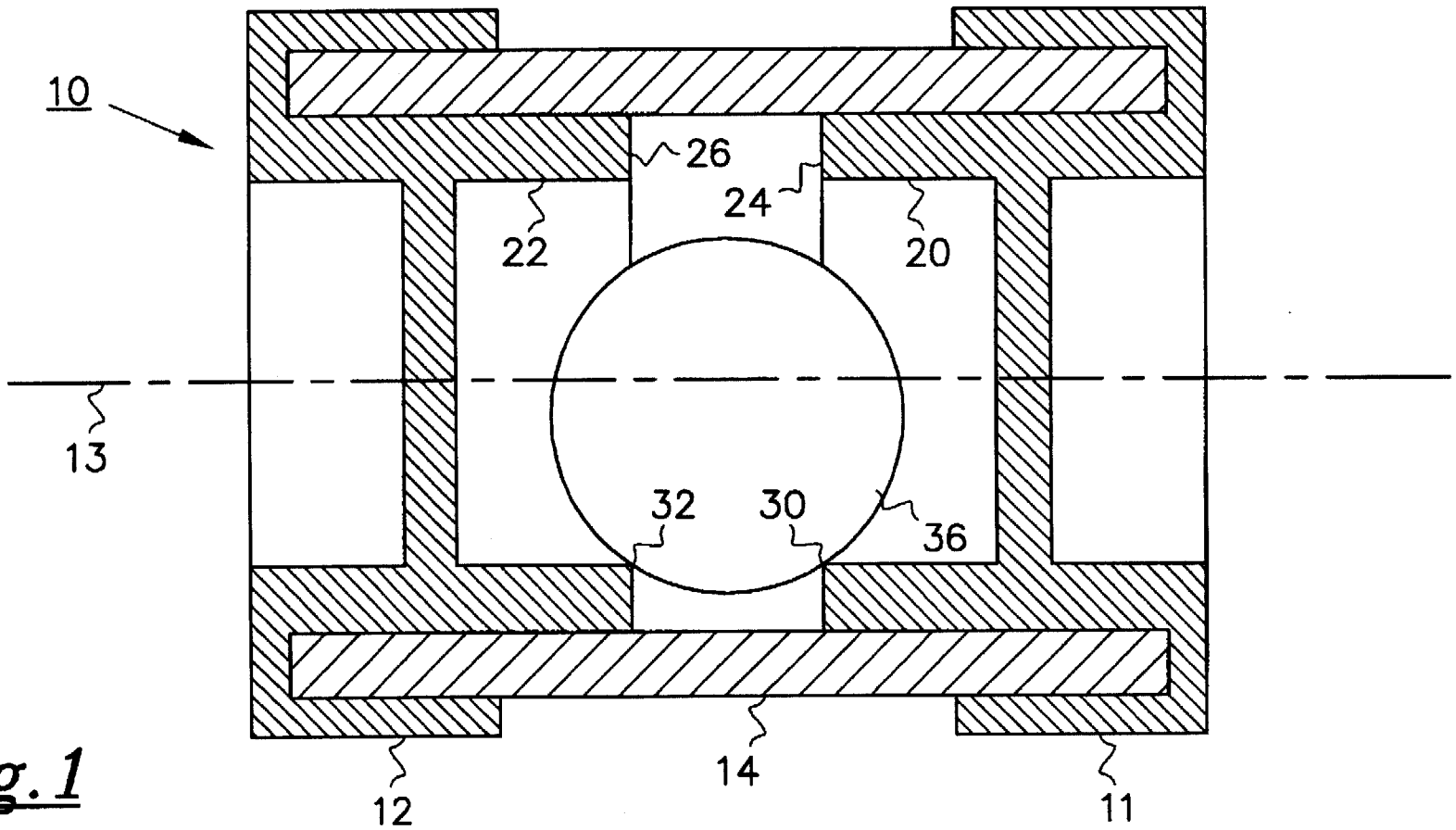
Fig. 1 (PRIOR ART)
FIG. 1 shows a cross section of a tilt switch known to those skilled in the art and described in detail in U.S. Pat. No. 5,136,127.

Throughout the Description of the Preferred Embodiment, like components will be identified by like reference numerals. U.S. Pat. No. 5,136,127, which issued to Blair on Aug. 4, 1992, is explicitly incorporated by reference in this application.

FIG. 1 shows a tilt switch such as that which is described in U.S. Pat. No. 5,136,127. The tilt switch 10 comprises a first electrically conductive member 11 and a second electrically conductive member 12. The two electrically conductive members, 11 and 12, are generally cylindrical and concentric with each other and with centerline 13. An insulative cylinder 14 is attached to both electrically conductive members and provides insulative support for the two members. The first electrically conductive member 11 has an inner cylindrical surface 20 and the second electrically conductive member 12 has a inner cylindrical surface 22. The end faces, 24 and 26, of the first and second electrically conductive members intersect with their respective inner cylindrical surfaces to form first and second contact points, 30 and 32. Throughout the description of the present invention, the locations identified by reference numerals 30 and 32 are alternatively referred to as support contact points and support edges. As shown in FIG. 1, an electrically conductive sphere 36 is disposed between the first and second electrically conductive members, 11 and 12, and supported by the first and second contact points, 30 and 32.

Figure 2:
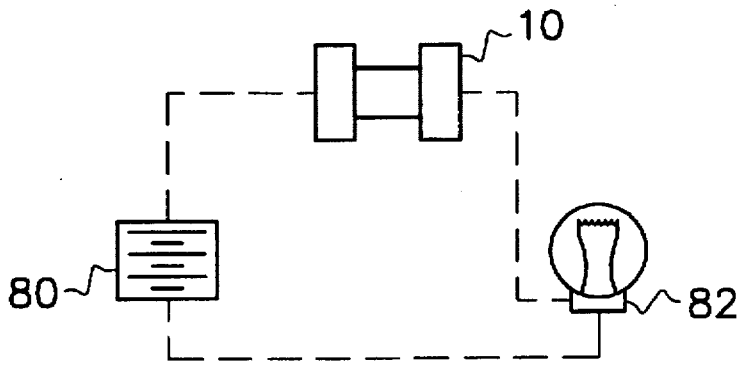
Fig.2 (PRIOR ART)
FIG. 2 shows a tilt switch connected in a circuit with a power source and a lamp.

FIG. 2 shows a typical circuit arrangement in which the tilt switch 10 is connected in serial electrical communication with a source of power 80 and a lamp 82. The arrangement shown in FIG. 2 can be employed to complete the electrical circuit when the tilt switch 10 is disposed within an angular conductive range that results from the electrically conductive sphere 36 being in contact with the first and second edges, 30 and 32, to cause the first and second electrically conductive members, 11 and 12, to be connected in electrical communication with each other. In other words, the sphere 36 bridges the gap between the first and second edges and completes the electrical circuit to provide power to the lamp 82. Naturally, the tilt switch described in U.S. Pat. No. 5,136,127 can be used in conjunction with electrical devices other than a lamp.

Figure 3:
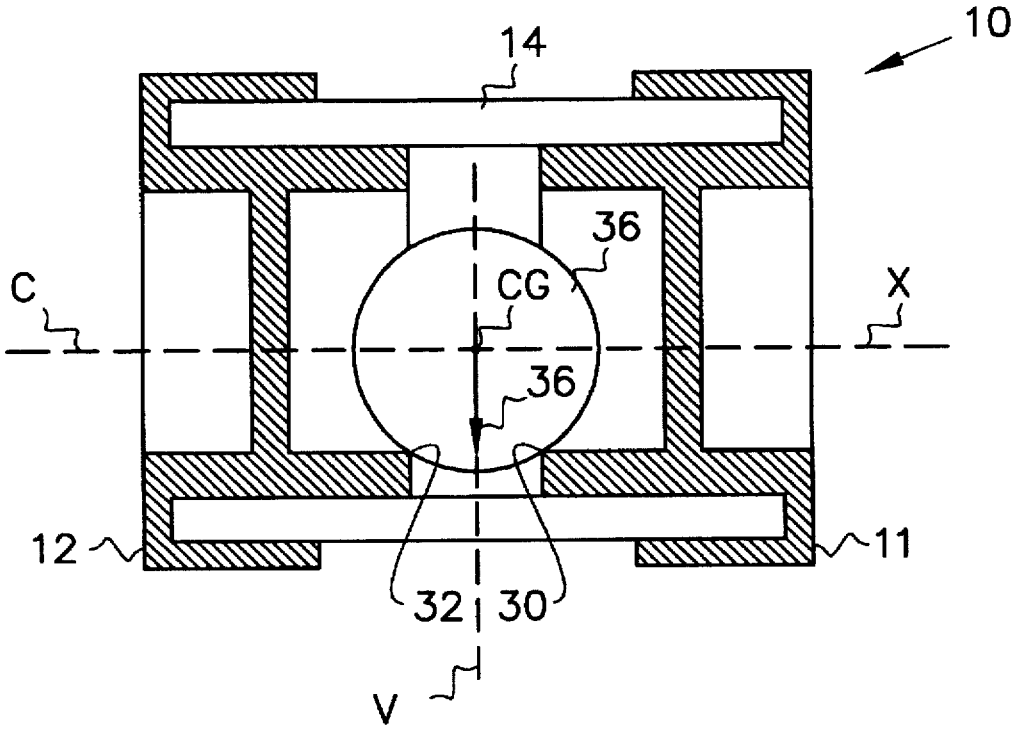
Fig.3 (PRIOR ART)
FIGS. 3, 4 and 5 show sectional views of the tilt switch of FIG. 1 titled at various angles.
Figure 4:
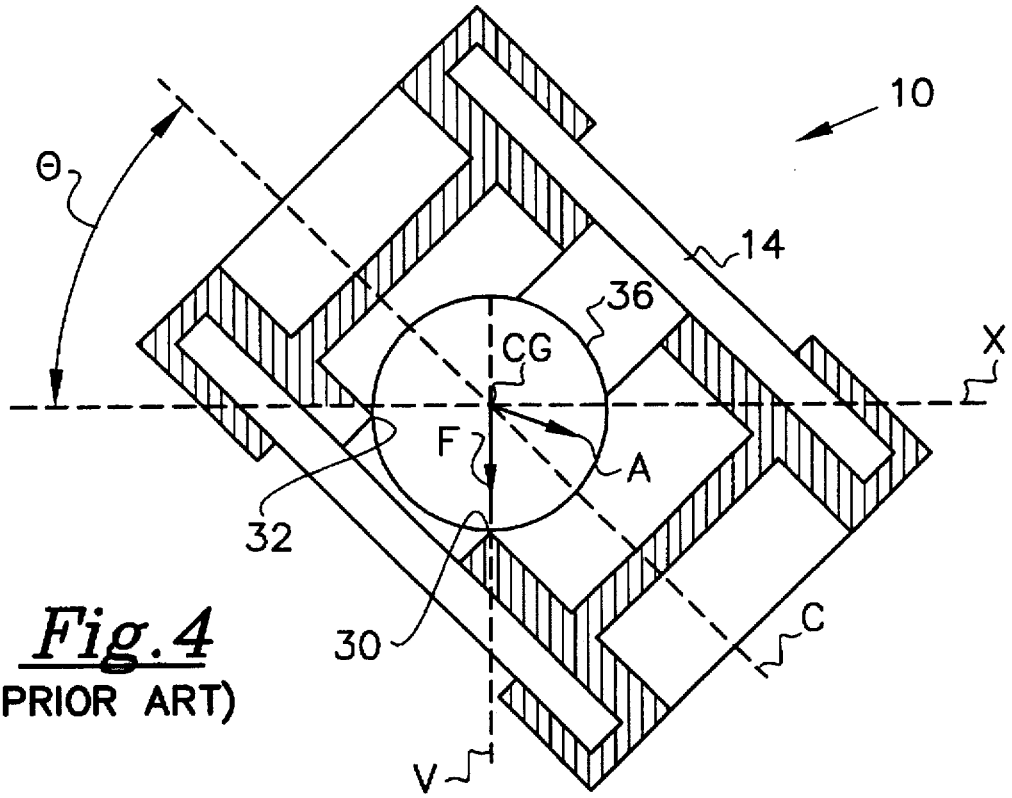
Fig.4 (PRIOR ART)
Figure 5:
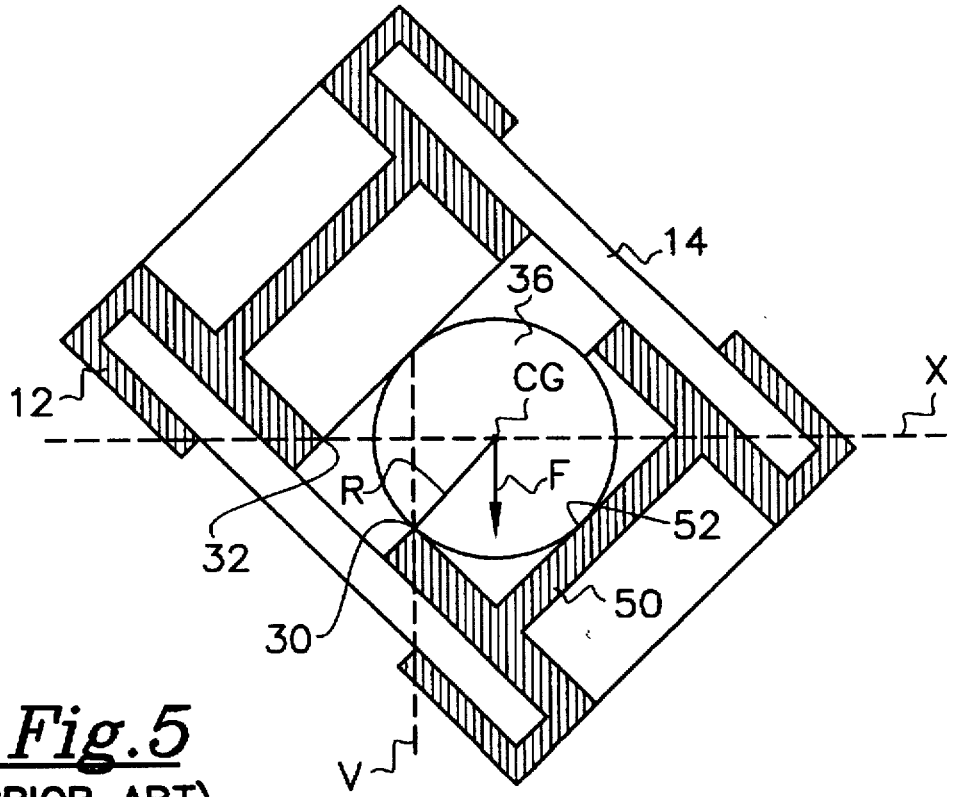
Fig.5 (PRIOR ART)

FIGS. 3, 4 and 5 show the switch of FIG. 1 tilted at various angles to illustrate the operation of the switch. In FIG. 3, the line identified by reference letter C represents a line that passes through the center of gravity of the sphere 36 and is parallel to the central axis 13 described above in conjunction with FIG. 1. Reference letter X is used to designate a horizontal reference line. In FIG. 3, lines C and X are coincident. The line identified by reference letter V represents a vertical line passing through the center of gravity of the sphere 36. With the force F, resulting from the weight of the sphere 36, extending between the first and second edges, 30 and 32, the sphere 36 will rest between the first and second electrically conductive members and will provide electrical contact therebetween. In the terminology of this description, the position shown in FIG. 3 is defined as the first position.

FIG. 4 shows the tilt switch 10 tilted so that line C is at an angle $\Theta$ relative to line X. As a result, force vector F passes through the point of contact between the sphere 36 and the first edge 30. If the tilt switch 10 is moved any farther from horizontal, in a clockwise direction, the sphere 36 will rotate about the first edge 30 in the direction represented by arrow A and the sphere will move out of contact with the second edge 32.

FIG. 5 illustrates the relationship between the sphere and the first and second electrically conductive members after the sphere 36 has rotated about the first edge 30 to move out of contact with the second edge 32. The position shown in FIG. 5 is referred to herein as the second position. In FIG. 5, a line R is shown extending between the center of gravity CG and the first edge 30. This line represents the line that must be moved to a vertical position before the sphere 36 will tend to move back toward contact with the second edge 32 as a result of rotation of the sphere about the contact point with the first edge 30. The angle between line V and the line R extending between the center of gravity CG and the first edge 30 represents the angle of rotation that the switch 10 must move in a counterclockwise direction before the sphere 36 will .rotate back into contact with the second edge 32.

Figure 6:
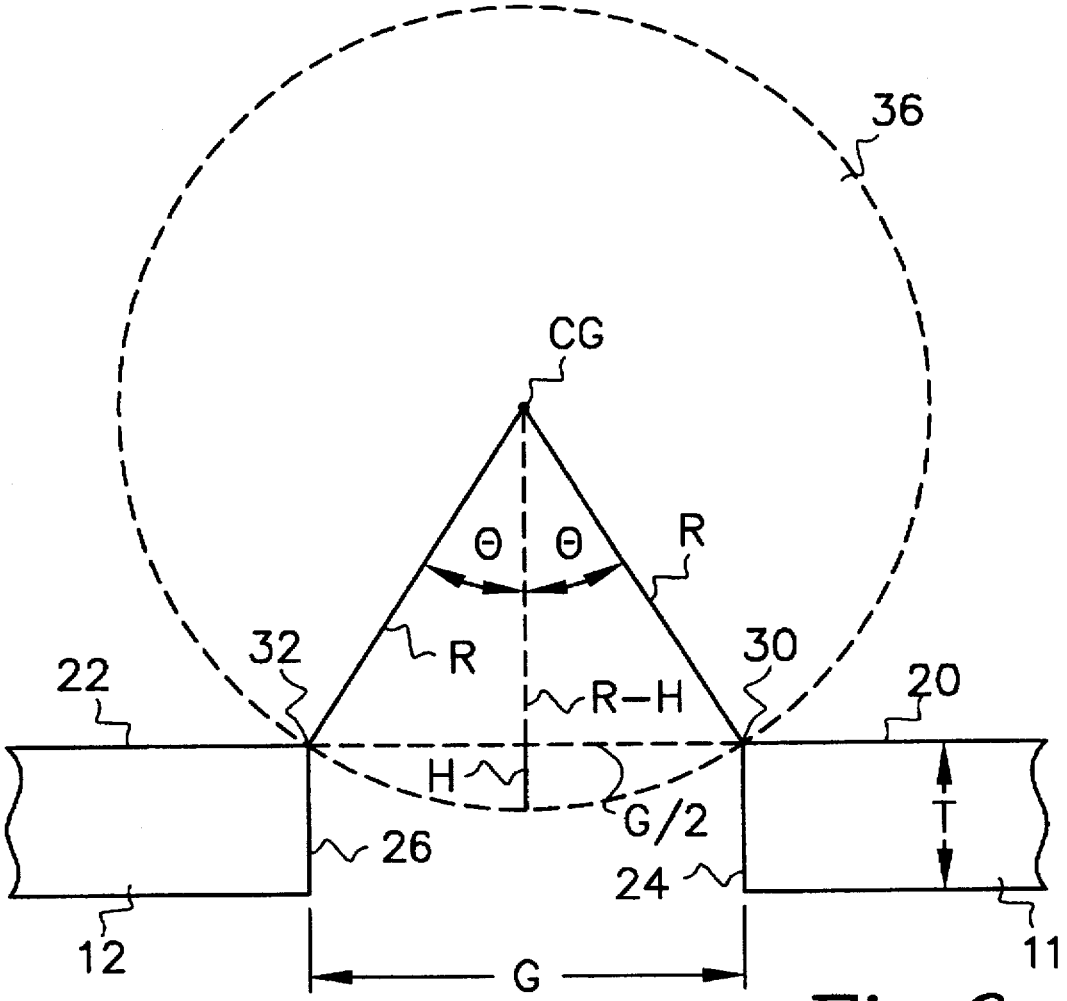
Fig. 6 (PRIOR ART)
FIG. 6 is a schematic representation of the tilt switch shown in FIG. 1 to illustrate certain geometric relationships.

FIG. 6 is a schematic representation of a sphere 36 resting between first and second edges, 30 and 32, formed at the intersections of the cylindrical surfaces, 20 and 22, and the end faces, 24 and 26, of first and second electrically conductive members, 11 and 12. Between the end faces, 24 and 26, a gap G is provided to space the first and second edges apart from each other. With the electrically conductive sphere 36 resting on the first and second edges, 30 and 32, the angular range of conduction between the first and second electrically conductive members is defined by the sum of the two angles identified as Θ. In other words, if the switch is rotated in a clockwise direction to place the center of gravity CG vertically above the first edge 30, any further rotation in a clockwise direction will cause the sphere 36 to move out of contact with the second edge 32. Similarly, if the tilt switch is rotated in a counterclockwise direction to place the center of gravity CG vertically above the second edge 32, any further movement in that direction will move the sphere 36 out of contact with the first edge. Therefore, these two limits in rotation define the angular conductive range that will maintain the sphere in contact with both electrically conductive members and maintain electrical conduction through the tilt switch. The relationship between angle Θ, the radius R of the sphere 36 and the gap G between the end faces, 24 and 26, are shown in equations 1 and 2.

$$\sin \Theta = G/2R \quad (1)$$

$$\Theta = \arcsin(G/2R) \quad (2)$$

Figure 7:
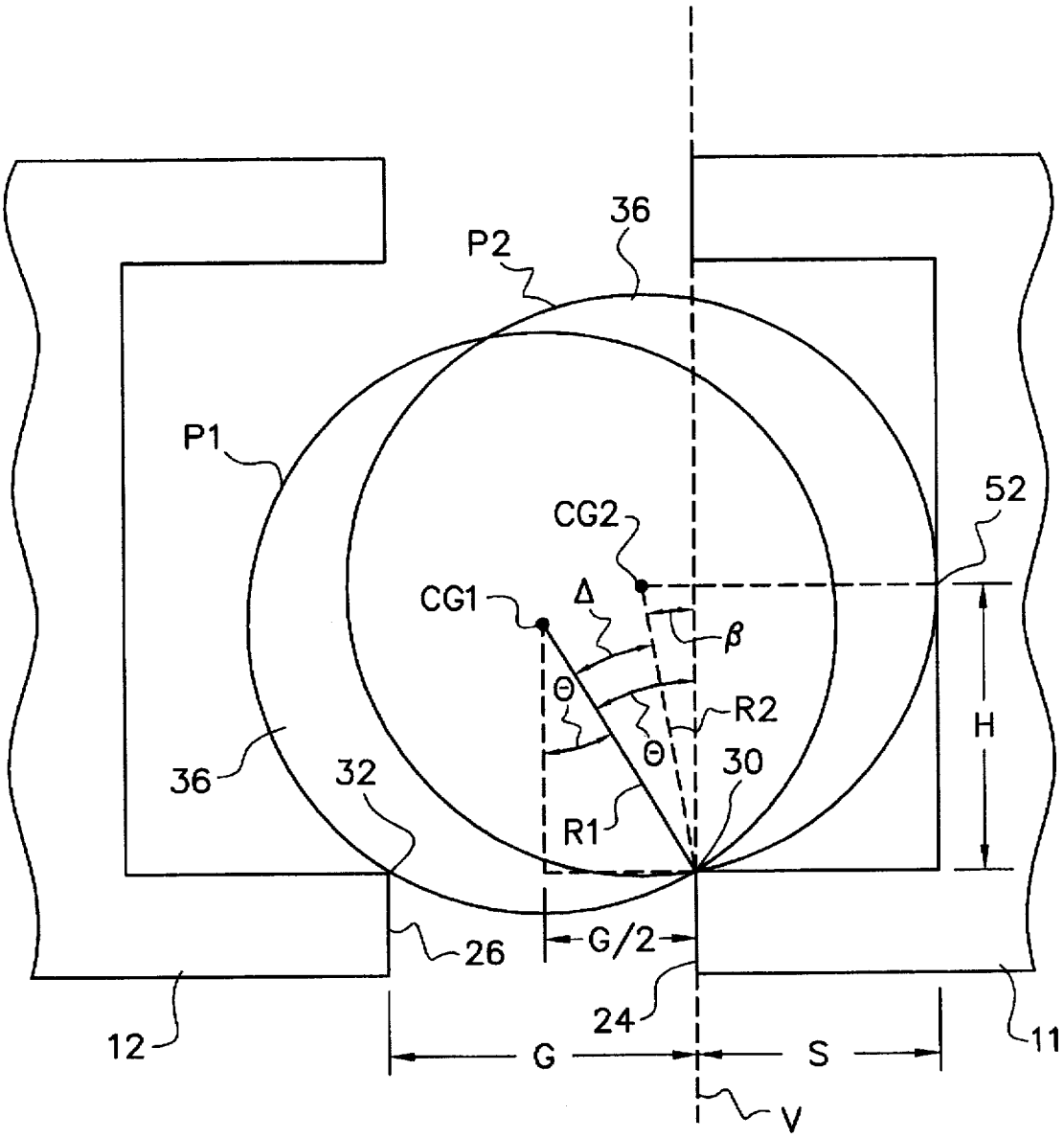
Fig. 7 (PRIOR ART)
FIG. 7 is a schematic representation of the switch shown in FIG. 1 to illustrate several additional geometric relationships.

FIG. 7 illustrates two positions, P1 and P2, of the sphere 36 to illustrate the differential characteristic of the tilt switch. Position P1 shows the sphere in the first position where it rests on the first and second contact points, 30 and 32, and provides electrical communication between the first and second electrically conductive members, 11 and 12. Position P2 shows the sphere after it has rotated about the first contact point 30 in a clockwise direction and has moved out of contact relation with the second contact point 32. The sphere 36 at position P2 is moved into contact with a wall of the first electrically conductive member 11 at contact point 52. Several lines and angles are identified in FIG. 7 to describe the differential characteristic of the switch. Angle Θ is described above in conjunction with FIG. 6. Angle β defines the angle between dashed line R2 and vertical line V in FIG. 7. As can be seen geometrically, the angle between line R1 and line V is equal to angle Θ. Therefore, angle A can be determined through the relationship shown in equation 3.

$$\Delta = \theta - \beta \quad (3)$$

As can be seen in FIG. 7, the sphere 36 will not pivot back to position P1 at the same switch angle where it initially pivoted from position P1 to position P2. This difference in the two pivot angles, between lines R1 and R2, is defined as the differential characteristic of the switch. In other words, the differential characteristic of a switch is, in effect, the mechanical hysteresis that is experienced as the switch is tilted in one direction and then back again in the opposite direction. As an example, if the switch in FIG. 7 begins to rotate in a clockwise direction from a horizontal position, the sphere 36 will remain in the first position P1 until line R1 is vertical and the center of gravity CG1 is directly above the contact point 30. Then, in response to gravity, the sphere 36 will continue to rotate in a clockwise direction until it moves to position P2 and moves into contact with the wall at point 52. However, if the switch is rotated in a counterclockwise direction back toward its initial horizontal position, the sphere 36 will not begin to pivot around the first contact point 30 when line R1 is vertical. Instead, the switch must continue to rotate in a counterclockwise direction until line R2 is vertical before the sphere 36 will begin to rotate in a counterclockwise direction around the first contact point 30 to move into contact with the second contact point 32. This characteristic of the switch, which causes it to reinitiate conductivity between the first and second electrically conductive members at a different angle than that which disconnected electrical continuity between the first and second electrically conductive members, is referred to as the differential characteristic of the switch. It is important to understand this characteristic in order to appreciate the benefits of the present invention which will be described in greater detail below.

With continued reference to FIG. 7, it can be seen that there is one way to increase the magnitude of angle Θ for the switch shown in the illustration. That method is to increase the magnitude of the gap G between the two end faces, 24 and 26, of the first and second electrically conductive members. Since the magnitude of angle Θ is determined by the relationship shown in equation 2, it can be increased by increasing the gap G or decreasing the radius R of the sphere 36. Since it is often impractical to decrease the size of the sphere 36 because of certain weight limitations that are necessary to provide the required contact force between the sphere and the contact points, the only practical method for increasing angle Θ is to increase the magnitude of gap G. However, a deleterious result can be caused by increasing gap G. As can be seen in FIG. 7, the differential angle Δ is determined by the relationship shown in equation 3. Since angle β is constant and is a function of the radius R of the sphere 36 and dimension S in FIG. 7, the magnitude of angle Δ is directly increased when angle Θ is increased. As the gap G is increased, the center of gravity CG1 is lowered, the angular range of conduction (i.e. 28) is increased and the differential angle Δ is increased. However, many applications can be adversely affected by an increase in the differential angle Δ. As an example, if the tilt switch 10 is employed in the hood of an automobile to cause a lamp to be energized when the hood is raised to a predetermined angle from horizontal, and the gap G is increased in order to achieve a larger angle θ, the result of the increased differential angle Δ will be that the lamp will not be extinguished until the hood is lowered to an angle that is closer to horizontal than the angle at which the lamp was turned on. If the differential angle Δ is increased significantly because of a change in the magnitude of gap G, the differential angle Δ could be increased sufficiently to actually prevent the lamp from being extinguished even when the hood of the automobile is completely closed and returned to its horizontal position. Although this deleterious result would not occur for every possible change in the magnitude of gap G, it can be seen that it is possible under certain circumstances and it can also be seen that the magnitude of the differential angle Δ is increased for every increase of the angle Θ.

Figure 8:
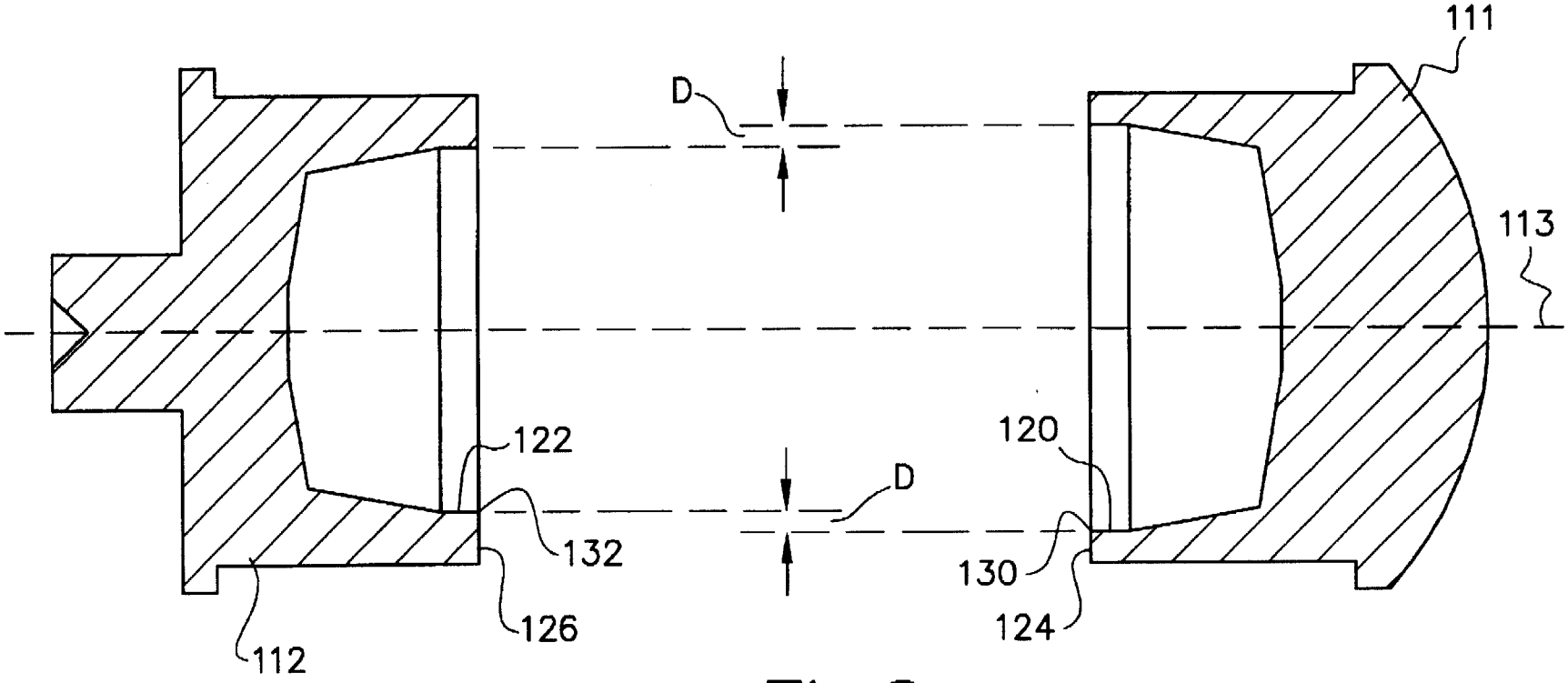
FIG. 8 shows the first and second electrically conductive members of the present invention.

FIG. 8 shows two electrically conductive members used to implement the improvement of the present invention. A first electrically conductive member 111 and a second electrically conductive member 112 are provided with inner cylindrical surfaces, 120 and 122, respectively. In addition, the first and second electrically conductive members are provided with end faces, 124 and 126, respectively. The intersections between the inner cylindrical surfaces and the end faces of the two electrically conductive members provides first and second contact points. Throughout the description of the present invention, the support points, 130 and 132, are alternatively referred to as edges, 130 and 132. The first contact point 130 and the second contact point 132 provide points of support for an electrically conductive sphere in the manner that will be described below. The diameter of the inner cylindrical surface 120 is greater than the diameter of the inner cylindrical surface 122. When the first and second electrically conductive members are disposed in concentric relation with each other and with the centerline 113, the common axis 113 of the two members is disposed at a farther distance from the first contact point 130 than from the second contact point 132. This characteristic of the present invention, which utilizes first and second electrically conductive members with different diameters of their respective inner cylindrical surfaces, provides a significant advantage in the control of the differential angle characteristics of the switch and allows the angular range of conduction to be significantly increased without the corresponding deleterious effect on the differential angle that occurs in tilt switches known to those skilled in the art. Although the first and second electrically conductive members shown in FIG. 8 are illustrated without any connecting member, it should be understood that a typical application of the present invention would connect the two conducting members together with a nonconductive tube that holds the electrically conductive members in a rigid relationship with each other and insulates the two members from each other.

Figure 9:
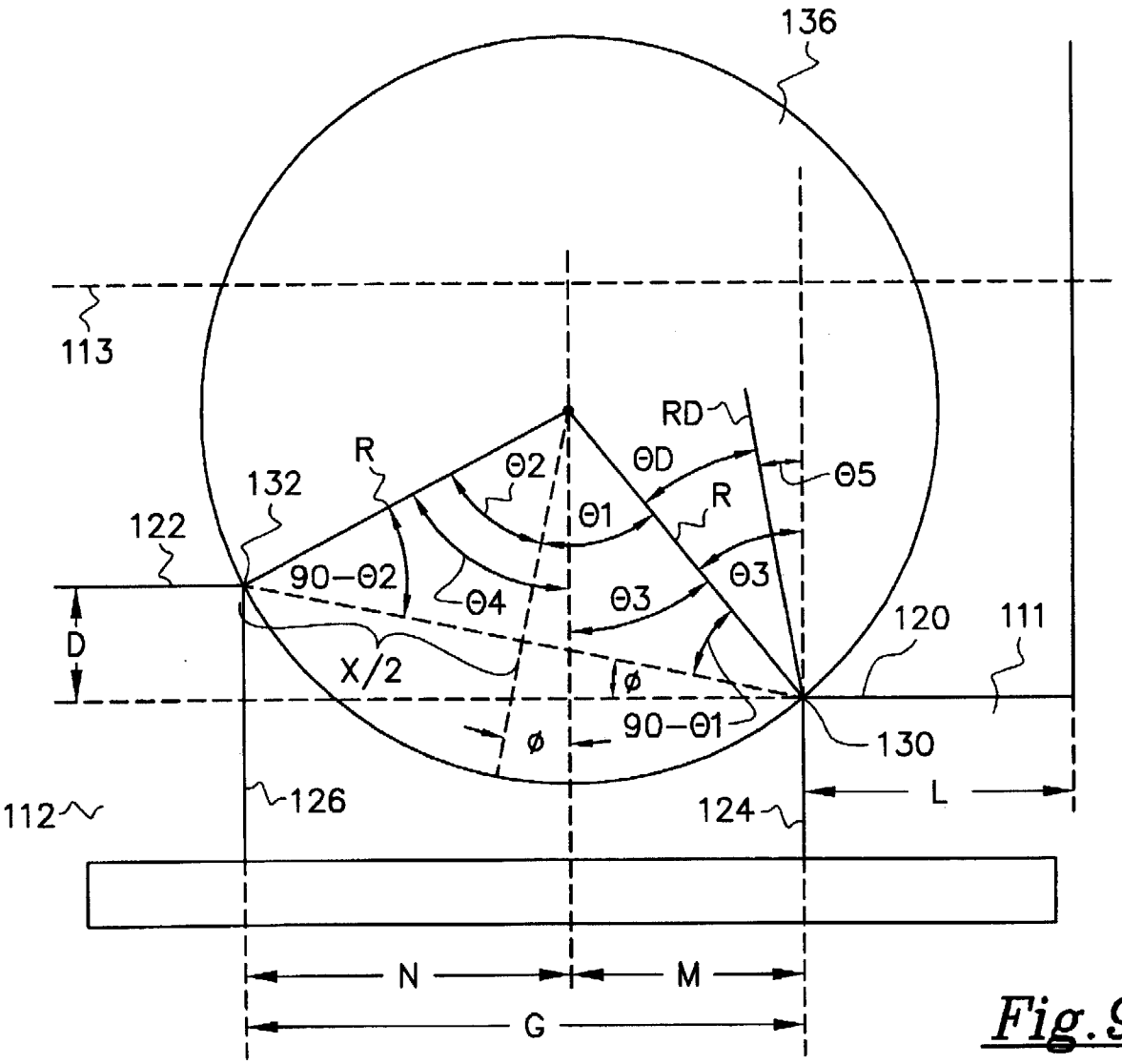
FIG. 9 is a simplified schematic representation of the operation of the present invention to show several geometric relationships.

FIG. 9 is a simplified schematic drawing of a conductive sphere 136 disposed between the first and second contact points, 130 and 132, within a tilt switch made in accordance with the concepts of the present invention. The first and second electrically conductive members are not shown in complete form in FIG. 9 for purposes of clarity. In order to understand the advantages provided by the present invention, it is important to understand how those advantages are provided. In FIG. 9, the relevant dimensions are identified. The total angle between the two radii is bisected by a dashed line which divides the total angle into two equal angles that are identified as Θ1 and Θ2. That dashed line is perpendicular to the line that extends between the first and second edges, 130 and 132. The difference in height between the first inner cylindrical surface 120 and the second inner cylindrical surface 122, relative to the common axis 113, is identified by reference letter D in FIG. 9. The total length of the dashed line extending between the first and second edges, 130 and 132, is equal to X. The half of the distance of that line is therefore equal to and identified as X/2. The magnitude of X can be determined from equation 4.

$$X^2=G^2+D^2 \tag{4}$$

With continued reference to FIG. 9, angles Θ1 and Θ2 can be calculated by equations 5 and 6 and the magnitude of angle Φ can be determined from equation 7. The angle between the radius R extending between the first edge 130 and the center of gravity of the sphere 136 and the vertical dashed line extending from the first edge 130 is defined as angle Θ3. Since angle Θ1 is equal to angle Θ2, as shown below in equation 8, angle Θ3 can be determined as a function of either angle Θ1 or angle Θ2. For example, equation 9 shows that angle Θ3 is equal to the difference between angle Θ1 and angle Φ. Angle Θ4 can be calculated as a function of angles Θ1, Θ2 and Θ3 as shown below in equation 10.

$$\sin \Theta 2=X/2R \tag{5}$$

$$\Theta 2=\arcsin (X/2R) \tag{6}$$

$$\Phi=\arcsin (D/X) \tag{7}$$

$$\Theta 1=\Theta 2 \tag{8}$$

$$\Theta 3=\Theta 1-\Phi \tag{9}$$

$$\Theta 4=\Theta 1+\Theta 2-\Theta 3 \tag{10}$$

When the magnitude of dimension D is greater than zero, the center of the sphere 136 will not be located directly above the center of the gap G. In other words, the dimensions identified as M and N in FIG. 9 will not be equal to each other. Equations 11 and 12 can be used to determine their magnitudes. As will be shown in greater detail below, the position of the sphere 136 changes with respect to the other elements of the tilt switch in response to changes in the magnitude of dimension D in a manner that is significantly different than the changes of position of the sphere that result from increases in the magnitude of the gap G. For example, as dimension D increases, the center of the sphere 136 moves upward and toward the right as the sphere 136 rotates in a clockwise direction about the first edge 130. This increases the total included angle between the two radii which is represented by the sum of angles Θ1 and Θ2. This, in itself, accomplishes an important goal in increasing the angular conduction range of the switch when that characteristic is desirable. However, it can also be seen in FIG. 9 that this same change in position of the sphere as a result of dimension D decreases angle Θ3. Since angle Θ5 is fixed, as will be described in greater detail below in conjunction with FIG. 10, a decrease in the magnitude of angle Θ3 will decrease the magnitude of angle ΘD. This decrease in the differential angle ΘD can be significantly beneficial in many applications and represents an important advantage of the present invention relative to the increase in the differential angle Δ if the gap G is increased as described above in conjunction with FIG. 7. Therefore, it can be seen that by causing the two inner cylindrical surfaces, 120 and 122, to be different in diameter, the provision of the difference D in the radii increases the angular conduction range, which is represented as angle Θ1 plus angle Θ2, and decreases the differential angle ΘD. In certain applications, both of these changes are beneficial.

$$M=R \sin \Theta 3 \tag{11}$$

$$N=G-M \tag{12}$$

Figure 10:
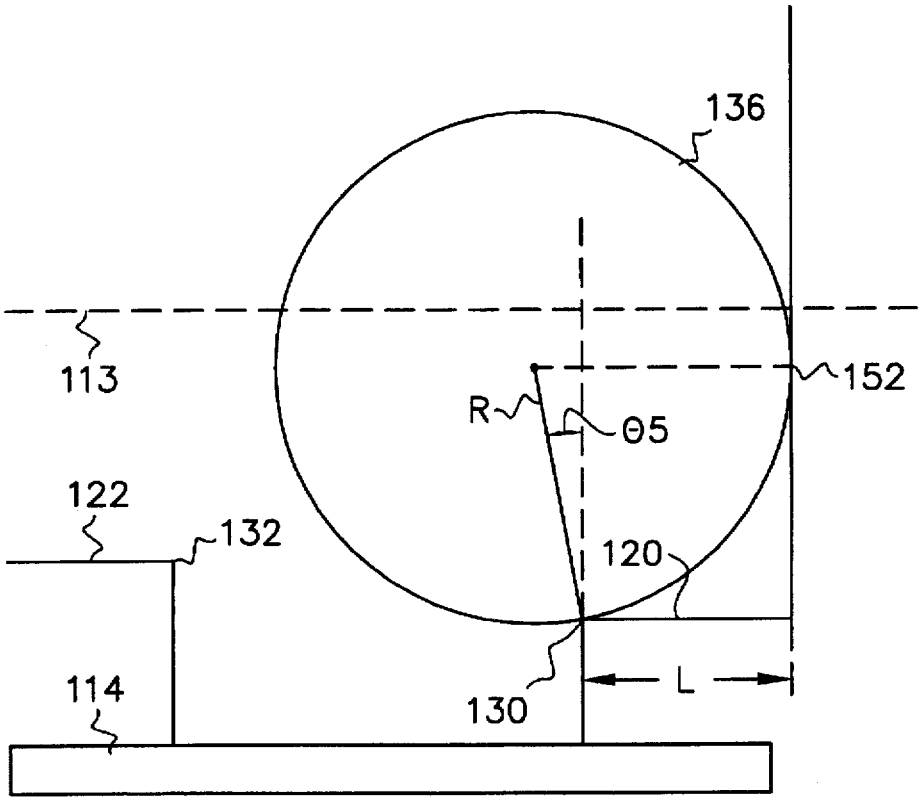
FIG. 10 illustrates an additional geometric relationship relevant to the operation of the present invention.

FIG. 10 shows the means by which the magnitude of angle Θ5 can be determined. As illustrated in FIG. 10, a vertical dashed line is constructed from the first edge 130 and another dashed line is constructed between the center of gravity of the sphere 136 and the contact point 152. Equation 13 shows the method of calculating the magnitude of angle Θ5 for cases where R is equal to or greater than L. As discussed above in conjunction with FIG. 9, the differential angle ΘD can be determined as a function of angle Θ3 and angle Θ5. This is illustrated in equation 14 below.

$$\Theta 5 = \arcsin((R-L)/R) \quad (13)$$

$$\Theta D = \Theta 3 - \Theta 5 \quad (14)$$

Figure 11:
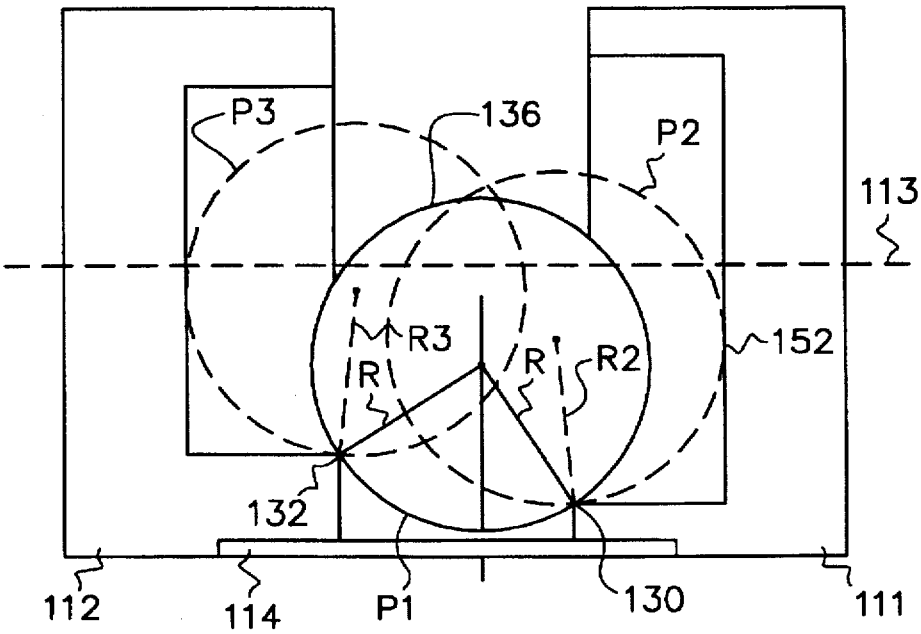
FIG. 11 shows the three positions attainable by a sphere within a switch made in accordance with the present invention.

FIG. 11 is a schematic view of the first and second electrically conductive members, 111 and 112, with the conductive sphere 136 shown in three possible positions. The first position P1 is defined by the sphere 136 being in contact with both the first edge 130 and the second edge 132. This provides electrical communication between the first and second electrically conductive members and completes the electrical circuit shown in FIG. 2. The second position P2, which is represented by dashed lines in FIG. 11, shows the sphere pivoted about the first edge 130 and moved out of contact with the second edge 132. The third position P3, represented by dashed lines in FIG. 11, shows the sphere pivoted about the second contact point 132 and in noncontact relation with the first contact point 130. As should be noted, the second position P2 is achieved when the tilt switch rotates in a clockwise direction and the third position P3 is achieved when the tilt switch rotates in a counterclockwise direction. The sphere 136 will rotate from the first position P1 to the second position P2 when the center of gravity of the sphere is vertically above the first contact point 130. Similarly, the sphere will move from position P1 to position P3 when the center of gravity of the sphere is vertically above the second contact point 132. When the sphere is in position P2, it will rotate in a counterclockwise direction about the first edge 130 to position P1 when dashed line R2 is vertical and the center of gravity of the sphere is directly above the first edge 130. The sphere will move from position P3 to position P1 when dashed line R3 is vertical and the center of gravity of the sphere is directly above the second edge 132.

With continued reference to FIG. 11, it should be understood that a switch of the type shown in the illustration has a single angular range of conduction, defined above as angle Θ1 plus angle Θ2, and two different differential angles. One differential angle is the angular difference between the lines extending from the center of gravity of the sphere to the first contact point 130 for positions P1 and P2. The second differential angle is the angle between the lines extending between the center of gravity of the sphere and the second contact point 132 for positions P1 and P3. As the magnitude of dimension D in FIG. 9 is increased, the differential angle between positions P1 and P2 can be decreased while the differential angle between positions P1 and P3 is increased. In certain applications, such as the switch which controls the lamp under the hood of an automobile, it is significantly advantageous to reduce the differential angle in one direction of travel even though the differential angle at the other end of travel is increased. Other dimensional changes, such as a further reduction in the diameter of the second electrically conductive member 112 in FIG. 12 relative to the size of the sphere 136, can further reduce the differential between positions P1 and P3.

Figure 12:
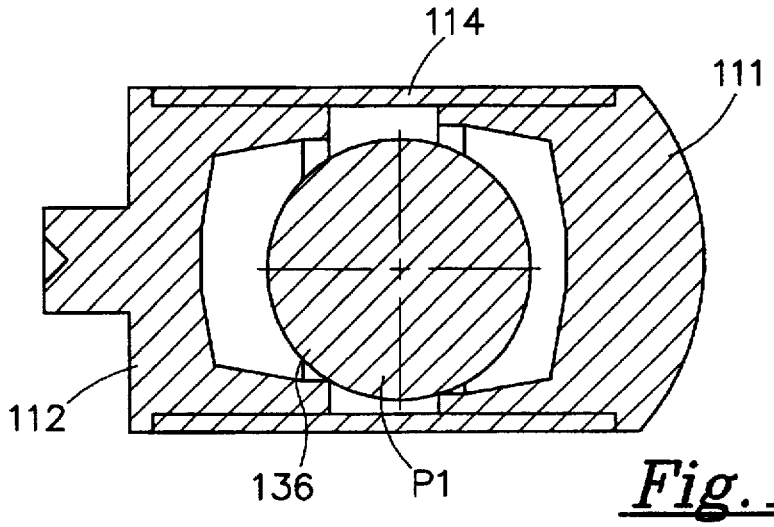
FIGS. 12, 13 and 14 show section views of the present invention at different tilt angles.

FIG. 12 is a sectional view of a switch made in accordance with the present invention and with the sphere 136 disposed in a first position P1 and providing electrical communication between the first electrically conductive member 111 and the second electrically conductive member 112. As described above in conjunction with FIG. 9, the sphere remains in the first position P1 as the tilt switch moves through an angular range defined by the sum of angles Θ1 and Θ2. From an initial horizontal position, movement of the switch in a clockwise direction through an angle Θ3 will cause the sphere 136 to move from position P1 to position P2.

Figure 13:
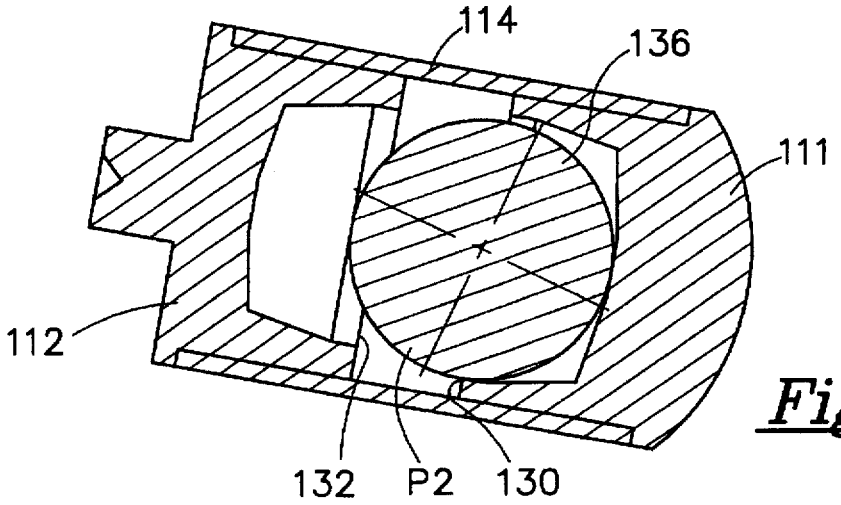

FIG. 13 shows the sphere 136 in its second position P2 which is defined by contact between the sphere and the first contact point 130 and by noncontact between the sphere 136 and the second contact point 132. When the sphere is in the second position P2, electrical continuity in the circuit shown in FIG. 2 is broken because of the lack of electrical communication between the first and second electrically conductive members, 111 and 112.

Figure 14:
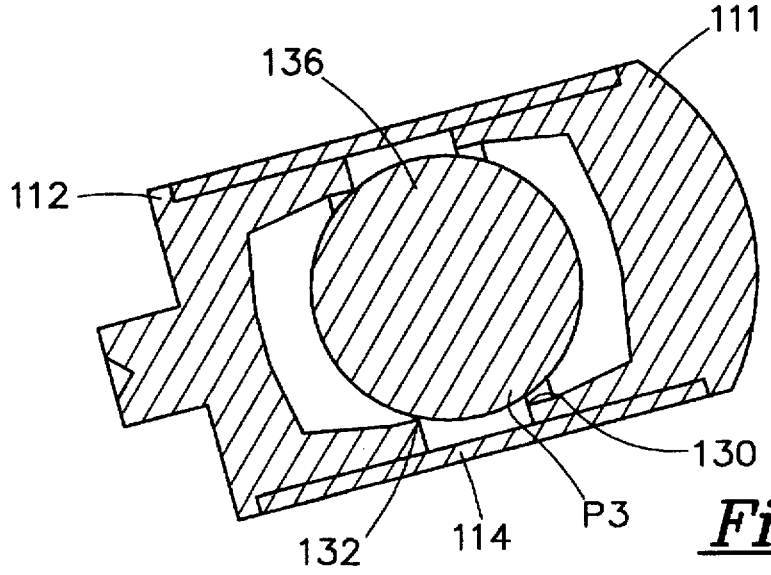

FIG. 14 shows the sphere 136 in the third position P3 which is defined by contact between the sphere and the second edge 132 and noncontact between the sphere and the first edge 130. The switch moves from the first position P1 to the third position P3 when it is rotated in a counterclockwise direction through an angle Θ4 in FIG. 9.

FIG. 15 is a tabular representation of the dimensions shown in FIG. 9. The magnitudes of angles Θ1, Θ2, Θ3, Θ4, Θ5, the differential angle ΘD and angle Φ are shown in the table of FIG. 15 for several magnitudes of dimension D. The radius R, dimension L and the gap G are constant for all of the rows in the table of FIG. 15. The linear dimensions X, M and N are also shown in the table. As dimension D is increased from zero to 0.060 inches, the angular conductive range increases from 53.231 degrees to 61.093 degrees as shown in the column for the sum of angles Θ1 and Θ2. However, the differential angle ΘD is reduced from 24.323 degrees to 0.075 degrees as a result of that same change in dimension D. Both of these changes are beneficial in certain applications, such as the control of a lamp in the hood of an automobile. The results shown in FIG. 15 are graphically represented in FIG. 17 which will be described in greater detail below.

Figure 18:
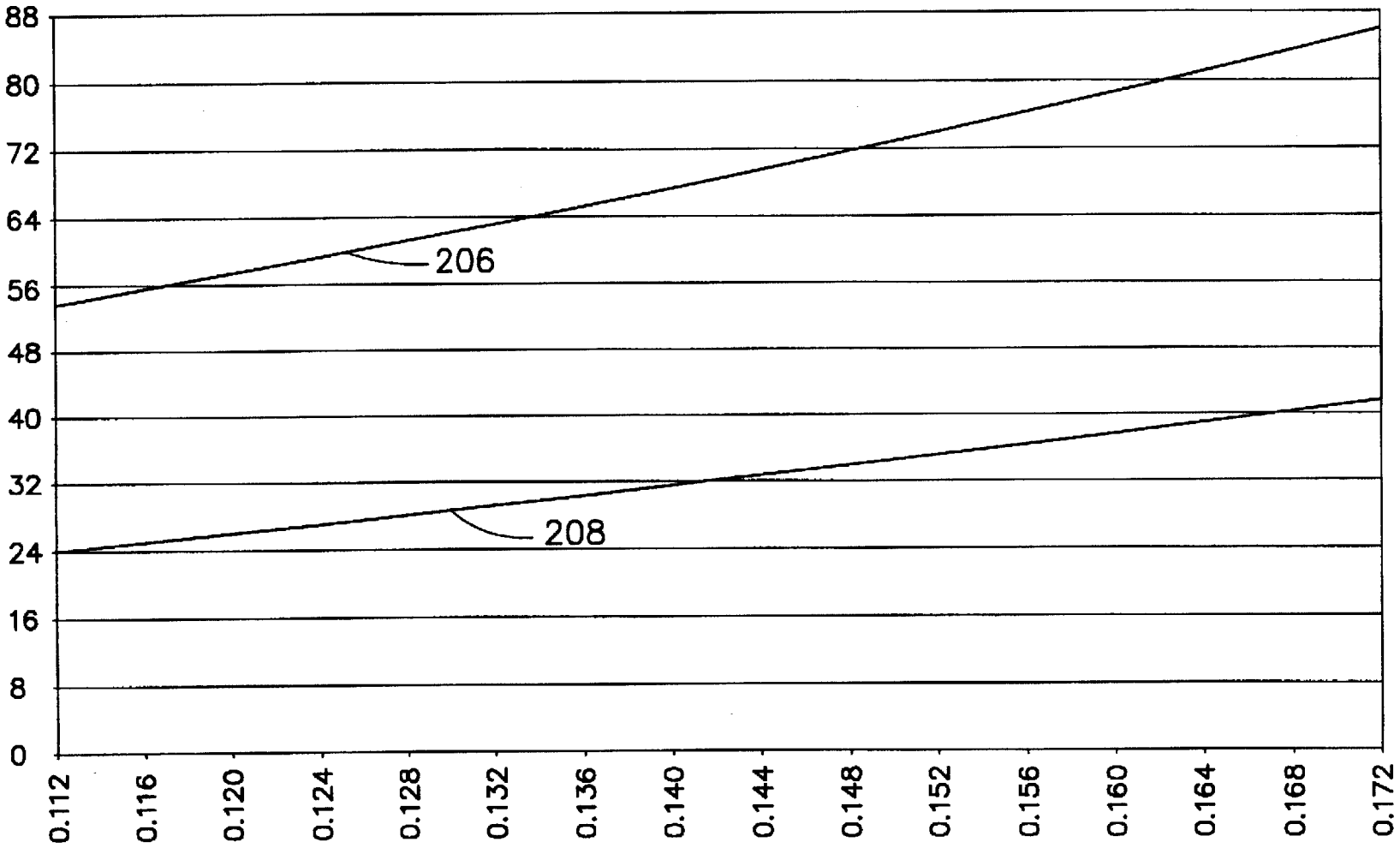
FIG. 18 is a graphical representation of selected data from FIG. 16.

In order to appreciate the advantages of the present invention, it is helpful to see the effective changes that would result from the alternative approach of expanding the magnitude of gap G between the end faces of the first and second electrically conductive members in known switches. The table in FIG. 16 shows the resulting magnitudes of angles Θ1, Θ2, Θ3, Θ4, Θ5, Θ1 and Φ for various magnitudes of the gap G ranging from 0.112 inches to 0.172 inches. The radius R and dimension L remain the same as in FIG. 15. Dimension D, of course, is zero because the prior art teaches that the two inner cylindrical surfaces of the end caps in a tilt switch are of equal diameter. As the gap G is increased, the angular conductive range increases from 53.231 degrees to 86.944 degrees. However, the differential angle ΘD increases from 24.323 degrees to 41.180 degrees. This significant increase in the differential angle ΘD can be extremely deleterious in certain applications as will be described in greater detail below. FIG. 18 is a graphical representation of the angular conductive range and differential angle shown in FIG. 16 for various magnitudes of dimension G.

Figure 17:
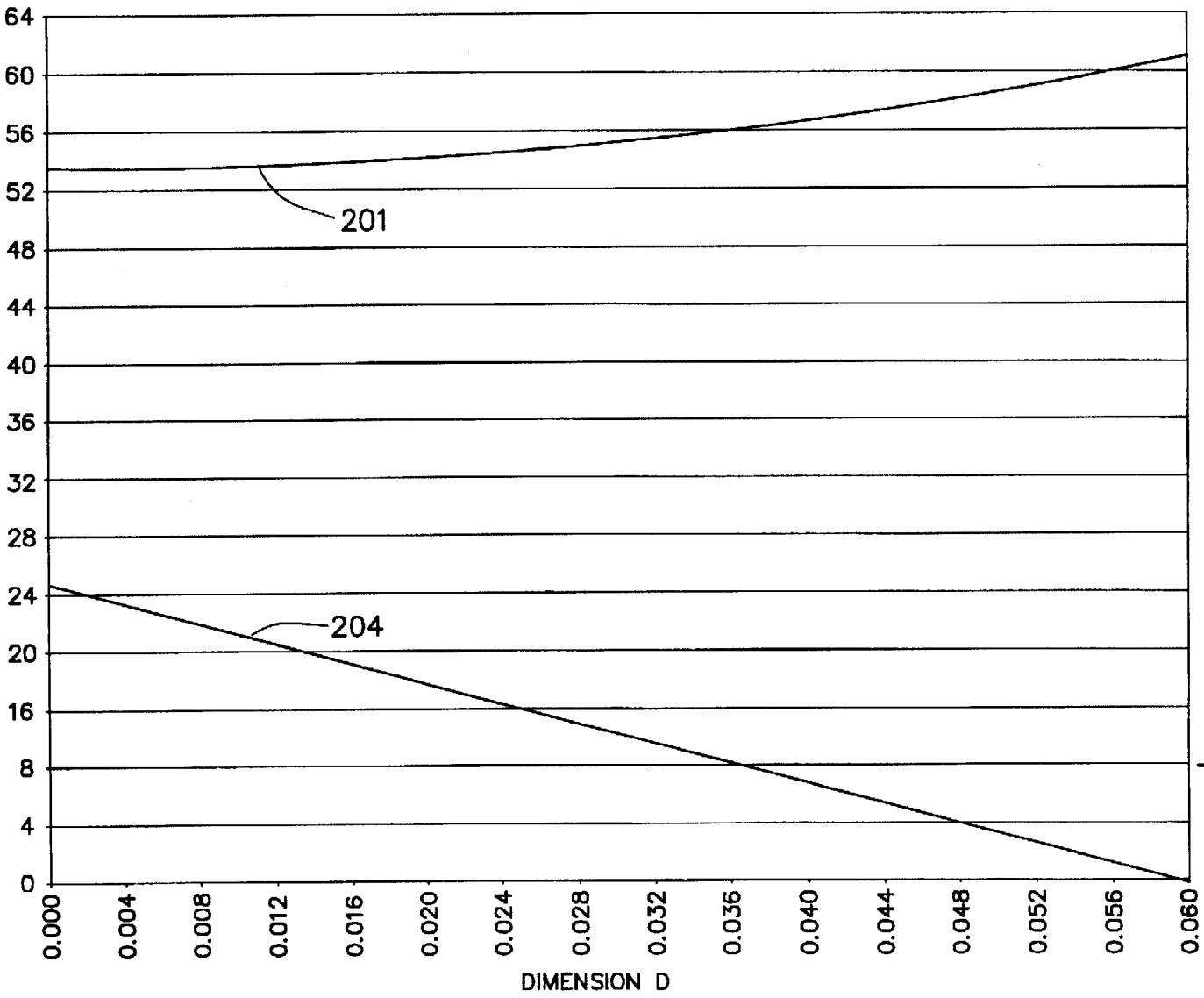
FIG. 17 is a graphical representation of selected data from FIG. 15.

FIGS. 17 and 18 provide a graphical comparison between the present invention and tilt switches that are known to those skilled in the art. In FIG. 17, line 201 represents the change in the sum of angles Θ1 and Θ2 which is referred to herein as the angular conductive range of the switch. Line 204 represents the differential angle ΘD that exists between positions P1 and P2 in the illustrations described above. As can be seen in FIG. 17, the increase in the angular conductive range 201 is accompanied by a decrease in the differential angle 204. In comparison, FIG. 18 shows the same two variables as a function of changes in the gap G. Line 206 shows the change in the angular conductive range, angle Θ1 plus angle Θ2, and line 208 shows the increase in the differential angle ΘD as a result of increases in the gap G.

With reference to FIGS. 17 and 18, it can be seen that a switch such as that described in U.S. Pat. No. 5,136,127 and known to those skilled in the art can be modified to increase the angular conductive range of the switch. However, if the switch is modified by increasing the magnitude of gap G, in the increase in the angular conductive range is accompanied by a corresponding increase in the differential angle ΘD. This increase in the differential characteristic of the switch can be significantly disadvantageous in certain applications. The present invention, as illustrated in FIG. 17, enables the switch to be modified in such a way that its angular conductive range is increased while the differential angle ΘD is decreased.

Figure 19:
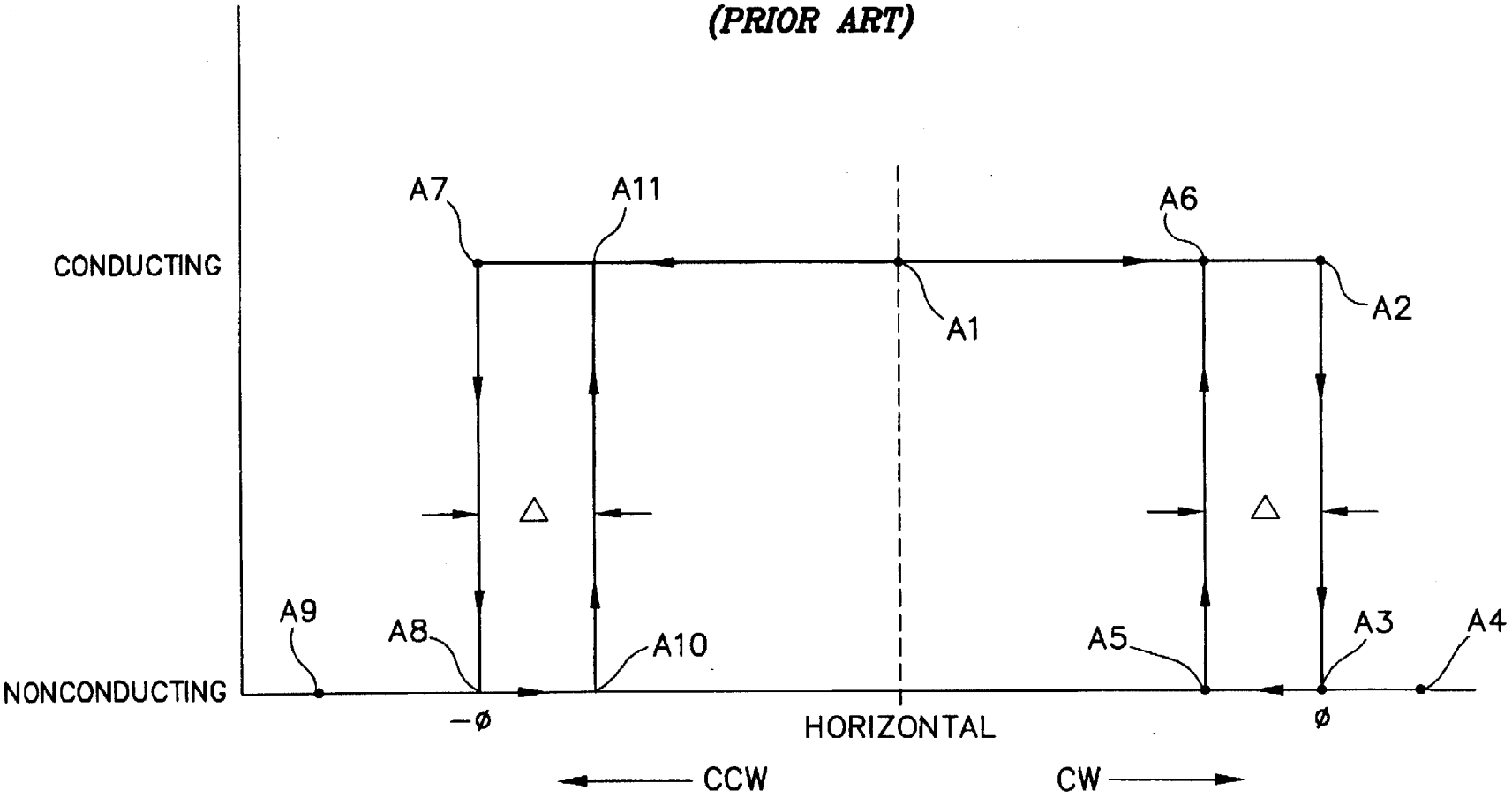
Fig. 19 (PRIOR ART)
FIG. 19 is a graphical representation of the conducting and nonconducting status of a switch made in accordance with the principles known to those skilled in the art.
Figure 20:
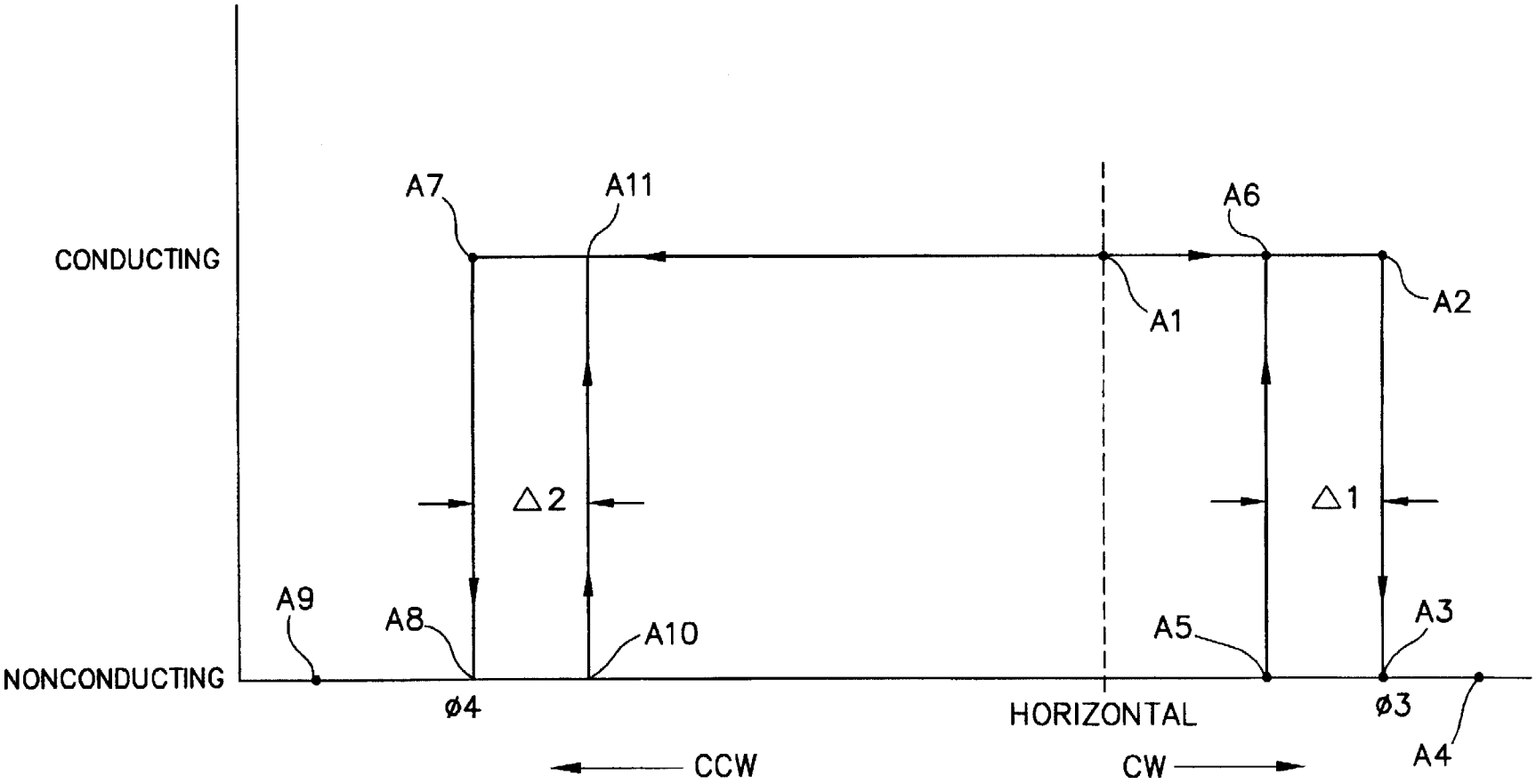
FIG. 20 shows the conducting and nonconducting status of a switch made in accordance with the principles of the present invention.

In order to further understand the advantages of the present invention, FIGS. 19 and 20 compare the results of the changes in the angular conductive range and differential angles for switches known to those skilled in the art and for the present invention, respectively. With reference to FIGS. 7 and 19, the graphical representation illustrated in FIG. 19 shows the changes from conducting to nonconducting status and vice versa for a switch known to those skilled in the art. Beginning at the point identified as A1 in FIG. 19, where the switch is in a horizontal position, a clockwise rotation to position A2 will place the center of gravity CG1 of the conductive sphere 36 directly above the first contact point 30. This represents a clockwise rotation of Θ degrees. When this occurs, any slight movement beyond angle Θ will cause the sphere 36 to rotate about the first contact point 30 and move into contact with the wall at contact point 52. This position is identified as A3 in FIG. 19. Any further rotation in a clockwise direction will cause the switch to remain in a nonconducting state. This further rotation is represented as location A4 in FIG. 19.

With continued reference to FIG. 19, a counterclockwise rotation from location A4 will not cause the sphere to move into contact with the second contact point 32 at location A3 because of the movement of the sphere 36 about the first contact point 30. In other words, the center of gravity CG2 must be vertically above the first contact point 30 before rotation will cause the sphere to move back into contact with the second contact point 32. This point is identified as A5 in FIG. 19. As can be seen, the difference between points A3 and A5 is the differential angle Δ described above. Continued counterclockwise rotation of the switch will move the sphere into conducting status between the first and second contact points. This is represented as location A6 in FIG. 19. Further counterclockwise rotation will eventually cause the center of gravity CG1 of the sphere 36 to be directly above the second edge 32. This is represented as location A7. Further movement will cause the ball to move out of contact with the first edge 30 at A8. Further counterclockwise rotation will move the switch to location A9 where it remains in nonconducting status. If the switch is rotated in a clockwise direction from location A9, it does not change state at A8 but, instead, must move to A10 before the sphere 36 will rotate about the second edge 32 and move back into contact with the first edge 30. Continued movement will cause this change in status from location P3 to location P1 and cause the sphere 36 to provide electrical communication between the first and second electrically conductive members, 11 and 12. As the switch is repeatedly rocked back and fourth, the sequence of status described above will repeat. It is important to note that the tilt switch does not turn back on at the same angle where it is turned off at either limit of travel. In other words, locations A3 and A5 differ by the differential angle Δ. Similarly, locations A8 and A10 also differ by the differential angle.

With continued reference to FIG. 19, if an attempt is made to modify an existing switch by expanding the magnitude of the gap G as described above in conjunction with FIGS. 16 and 18, the differential angle A between points A3 and A5 in FIG. 19 would be increased. Although a beneficial effect can be gained by expanding gap G and increasing the angular conductive range between points A6 and A11, the corresponding disadvantageous result of increasing the differential angle can possibly make this type of modification impractical in certain applications. For example, if it is desired that the hood of an automobile be provided with a light that remains energized from a point where the hood is only slightly opened to a point where the hood is opened to its full extent, a tilt switch made in accordance with the prior art could possibly be modified by expanding the gap G. However, if the increase in magnitude of gap G also increases the differential angle A, the modification might cause the lamp to remain energized even after the hood is completely closed. This would result because the differential angle requires the switch to be tilted to an angle beyond the angle at which the ball moved into its first position P1 where it is in contact with both end caps of the switch. Obviously, this problem would be severely exacerbated by an increase in the differential angle A that occurs when the gap G is increased to achieve the increased angular conductive range of the switch.

The present invention, on the other hand, enables the angular conductive range of the switch to be increased without increasing the differential angle. In fact, the differential angle is decreased by modifying a known switch in the manner described above, wherein the dimension D is provided by implementing first and second electrically conductive members that have different diameters of their inner cylindrical surfaces.

FIG. 20 is similar to FIG. 19, but the distance between A6 and A11 is increased while the distance between A3 and A5 is decreased. The differential angles are identified as A1 and A2 in FIG. 20 in order to distinguish them from each other. It should be understood that the differential angles at both limits of travel in a switch made in accordance with the present invention can be significantly different from each other. In other words, the lines represented in FIG. 11 by dashed lines R2 and R3 are not necessarily symmetrical with each other. In fact, it is highly unlikely that these two dashed lines would be symmetrical with each other in most embodiments of the present invention.

Figure 21A:
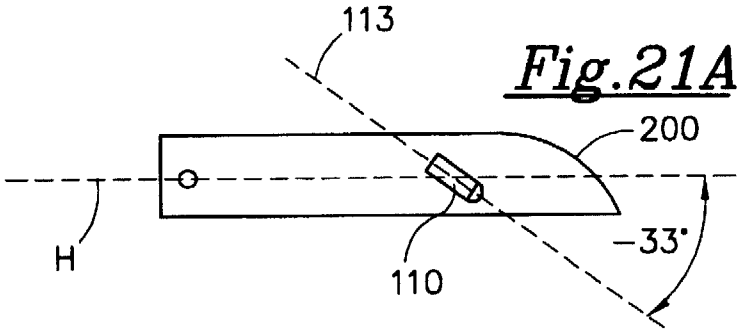
FIGS. 21A–21E show the hood of an automobile at various angles of tilt to illustrate the operation of the present invention and explain its primary advantage.
Figure 21B:
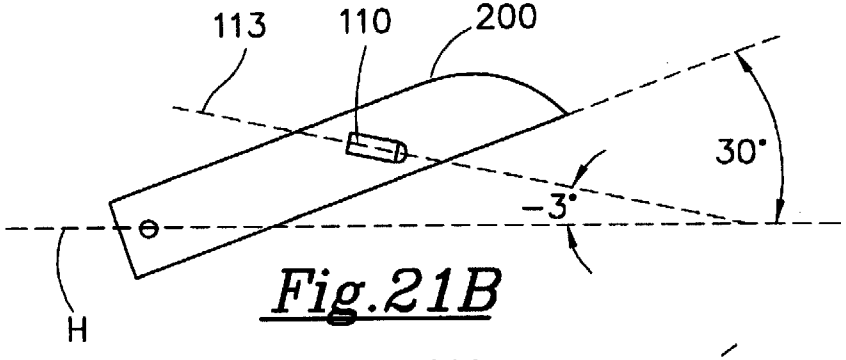

FIGS. 21A–21E are intended to illustrate the performance of the present invention in one particularly preferred embodiment where the tilt switch of the present invention is used in conjunction with the hood of a transportation vehicle. FIG. 21A shows the hood 200 disposed in a horizontal position generally parallel to the horizontal line H. The tilt switch 110 is mounted with its common axis 113 disposed at an angle of approximately −33 degrees with respect to the horizontal line H. This would place the switch 110 in a configuration generally similar to that illustrated in FIG. 13 with the sphere 136 in noncontact relation with the second edge 132. In other words, the lamp 82 shown in FIG. 2 would be off. If the hood 200 is rotated in a counterclockwise direction as represented in FIG. 21B, the switch 110 is also rotated in a counterclockwise direction. When the hood 200 is at an angle of 30 degrees to horizontal line H, the switch 110 is at an angle of −3 degrees with respect to the horizontal line H. This is a desirable angle at which to turn the light on. This is also the angle that causes the sphere 136 to rotate about the first contact point 130 and move into contact with the second contact point 132. This has been referred to as the first position P1. As the hood 200 moves from the position shown in FIG. 21A to the position shown in 21B, the sphere 136 moves from position P2 as shown in FIG. 113 to position P1 as shown in FIG. 12.

Figure 21C:
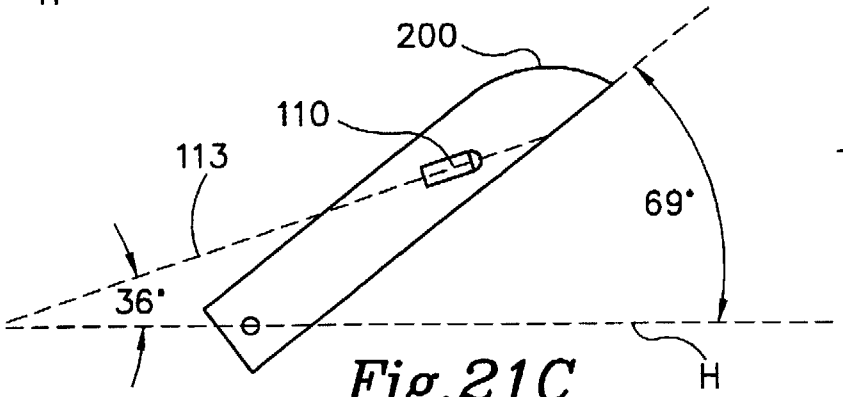

FIG. 21C shows the hood 200 in a fully raised position which would allow maintenance of the automobile engine. Since there is no reason to turn the light off when the hood is fully open, the dimensions of the tilt switch are selected so that the maximum opening of the hood 200 is insufficient to cause the tilt switch to move to an angle that would result in the sphere 136 moving into the third position P3. However, it should be clearly understood that certain other applications might require the switch to be moved into a nonconducting status at both ends of its travel range. In an automobile application, however, it is desirable to provide a limit switch 110 that remains in a conducting state through the angle of 69 degrees between the hood 200 and the horizontal line H.

Figure 21D:
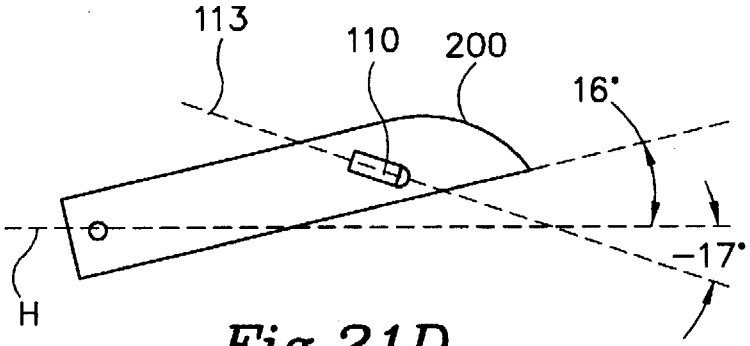
Figure 21E:
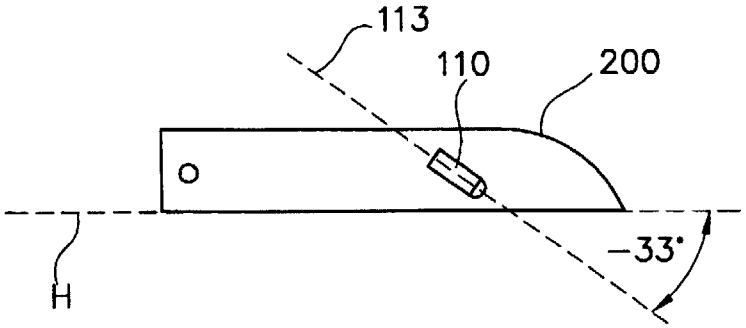

As the hood 200 is closed as indicated by arrow A in FIG. 21D, it eventually reaches an angle of 16 degrees to a horizontal line H. When this occurs, the switch 110 is at an angle of minus 17 degrees to the horizontal line H and the sphere 136 rotates about the first contact point 130 and moves out of contact with the second contact point 132. This causes the lamp to go off. Continued rotation of the hood 200 causes it to return to the horizontal position shown in FIG. 21E. It should be noted that the configuration in FIG. 21E is identical to that shown in FIG. 21A.

With reference to FIG. 21B and 21D, it should be noted that the switch 110 moves into a conducting status with the sphere 136 in the first position P1 at an angle of 30 degrees as the hood 200 is being raised in the direction indicated by arrow A. However, when the hood is moving in the opposite direction toward closure, the hood 200 must be moved down to an angle of 16 degrees with respect to the horizontal line H as indicated in FIG. 21D. The difference between these two angles, which is 14 degrees, is the differential angle ΘD that is described above in conjunction with FIG. 9. The results shown in FIGS. 21A–21E represent actual angles used in one particularly preferred embodiment of the present invention. If, on the other hand, a switch known to those skilled in the art with equal diameters at its inner cylindrical surfaces is modified in an attempt to achieve the increased angular conduction range, the differential angle would be significantly increased and the lamp would not be extinguished even after the hood 200 is moved to a horizontal position as represented in FIG. 21E. Rather than turning the lamp off at 16 degrees as shown in FIG. 21D, the lamp would never be extinguished once it is turned on as shown in FIG. 21B. Naturally, a switch with that type of differential characteristic is unacceptable for use in an automobile hood application.

Figure 22:
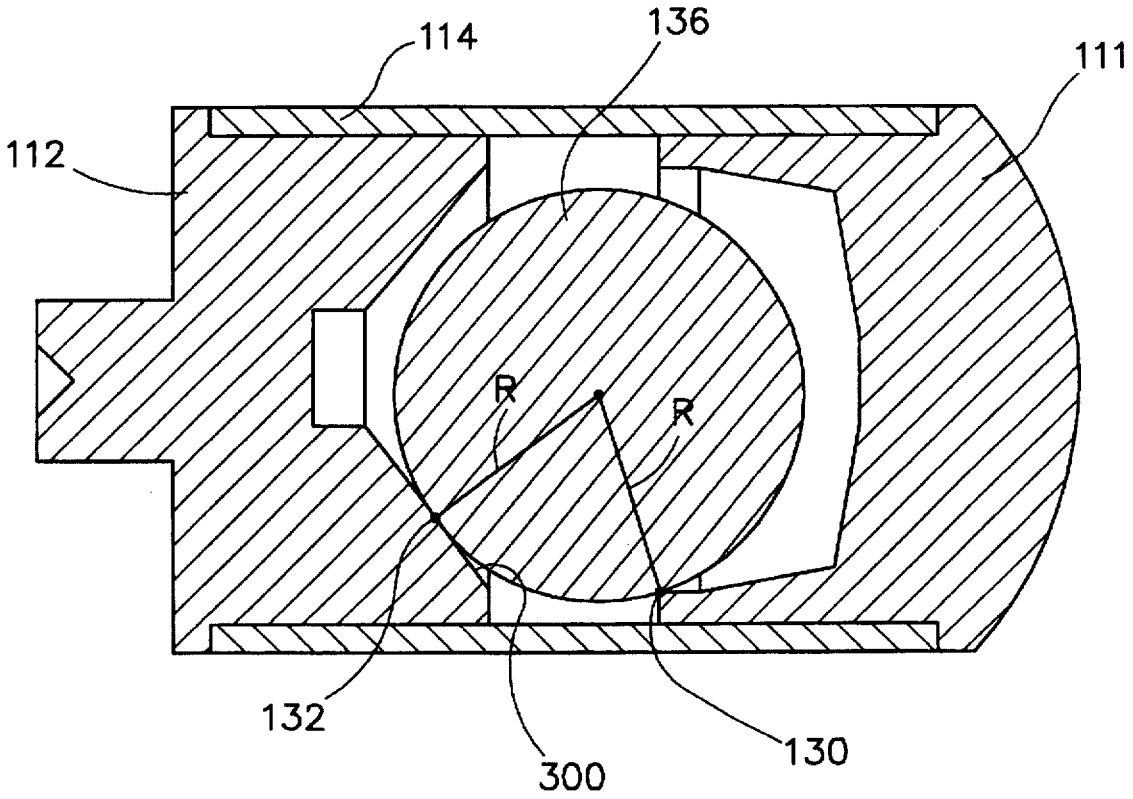
FIG. 22 shows an alternative configuration of the present invention comprising one edge and one generally flat support contact point.

In certain applications, it is very important that the sphere be prevented from moving into the third position P3 that is illustrated in FIG. 14. As an example, when the hood of a vehicle is fully opened, the hood lamp should not be extinguished even if the hood is opened slightly beyond its intended angle. For example, FIG. 21C shows the hood 200 of a vehicle opened at an angle that is sufficient to allow access to the engine of the automobile. Certain vehicle designs require that the hood be opened to a slightly greater angle to permit a support rod to be inserted into the hood to hold it in the opened position. During this process of opening the hood, it is not desirable to have the lamp turn off at any time during the process. If the angle of the opened hood 200 is extreme, the sphere 136 could move from the first position P1 to the third position P3 as described above in conjunction with FIGS. 12 and 14. The embodiment of the present invention that is shown in FIG. 22 decreases the likelihood that the sphere will move into the third position P3 when a hood of an automobile is fully opened. The first contact point 130 is provided in the manner described above in conjunction with FIG. 12. The first electrically conductive member 111 in FIGS. 12 and 22 are generally identical to each other. Furthermore, the electrically insulative tube 114 and the sphere 136 are generally identical in FIGS. 12 and 22. The second electrically conductive member 112 is shaped to provide a contact point 132 against a generally flat surface 300. By comparing the embodiment of the present invention shown in FIG. 22 with that shown in FIGS. 12–14, it can be seen that the second contact point 132 in FIG. 22 is not formed by the intersection of two surfaces of the first electrically conductive member 112. Instead, surface 300 is formed as the inner surface of a frustum of a cone.

In a tilt switch made in accordance with the embodiment of the present invention shown in FIG. 22, the sphere 136 would pivot about the first contact point 130 in the same manner described above in conjunction with the other embodiments of the present invention. The sphere 136 could pivot from the first position P1 shown in FIG. 12 to the second position P2 shown in FIG. 13. However, when the switch is moved in a counterclockwise direction, the sphere 136 would not pivot about an edge at the second contact point 132. In fact, the included angle between the radii R in FIG. 22 illustrates that the use of the conical surface 300 can also increase the angular range of conduction described above in conjunction with FIG. 9. The remaining operation of the present invention is the same when made in the embodiment shown in FIG. 22. The primary difference between the function of the switch shown in FIG. 22 and the function of the switch illustrated in FIGS. 12–14 is that the counterclockwise rotation of the sphere 136 about the contact point 132 is discouraged by the use of the surface 300 rather than the use of an edge to provide the contact point 132. Other than this difference, the operation of the switch in FIG. 22 is similar to the operation of the switch described above in conjunction with FIGS. 12–14.

In certain applications of the present invention, it may be beneficial to construct the switch with one angular range of conduction, but mount the switch to decrease the effect of that designed angular range of conduction. This is possible if the switch is mounted at a preselected offset angle relative to the hood. With reference to FIGS. 21A–21E, the above description of the operation of the present invention assumed that the switch was mounted in the plane of the taper. In other words, if the hood 200 was raised to a vertical position, the switch 110 and line 113 would both be vertical. However, it should be understood that an alternative mounting scheme could be employed. The switch 110 could be mounted at an angle to the hood 200. In other words, if the hood 200 is raised to a vertical position in FIG. 21C, the switch 110 would not be vertical if viewed from the right side of the drawing, looking toward the underside of the hood 200. This additional offset angle between the switch 110 and the hood 200 modifies the angular conduction angle with respect to the angle to which the hood 200 is raised. Although this type of mounting modification is not desirable in every application of the present invention, it can be used to change the natural effect that would otherwise occur from a particular selection of an angular conduction range for the switch 110.

Another significant disadvantage of modifying a known switch by increasing its gap G is that the diameter of the sphere may actually cause interference with the nonconducting tube that is used to support the end pieces. For example, with reference to FIG. 1, an increase in the gap between the end faces, 24 and 26, of the first and second electrically conductive members, 11 and 12, could result in a sufficient lowering of the sphere 36 between the first and second contact points, 30 and 32, to cause the sphere 36 to move into contact with the tube 14. If this occurs, the overall structure of the switch would have to be modified to increase the outside diameter of the first and second electrically conductive members where it is disposed in contact with the inside diameter of the tube 14. The contact between the sphere 36 and the tube 14 could be prevented, but this prevention would require the use of a larger diameter switch if the diameter of the sphere 36 remains constant. This represents an additional disadvantage to the modification of an existing switch such as that illustrated in FIG. 1 and in U.S. Pat. No. 5,136,127 if the gap G is enlarged to increase the angular conductive angle of the switch. The other disadvantage, as described above, is the corresponding increase in the differential angle of the switch. Therefore, a switch made in accordance with the present invention provides the ability to expand the angular conductive angle of a tilt switch without increasing its differential angle and without requiring the switch to be made with a larger diameter to prevent contact between the sphere and the nonconducting tube used to support the first and second electrically conductive members used as end caps for the switch. Although the present invention has been described with particular detail and illustrated with significant specificity to describe and explain the operation and structure of a preferred embodiment of the present invention, it should be clearly understood that alternative embodiments are also within its scope.

The embodiments of the invention in which an exclusive property or right is claimed are defined as follows:

1. A tilt switch, comprising:

a first electrically conductive member having a first contact point defined by the intersection of two surfaces of said first electrically conductive member;

a second electrically conductive member having a second contact point, said first and second electrically conductive members being aligned along a common axis;

means, attached to said first and second electrically conductive members, for supporting said first and second electrically conductive members in nonconducting relation with each other; and an electrically conductive sphere which is disposable in contact with said first and second contact points, said electrically conductive sphere being movable in response to a first change in position of said common axis relative to a horizontal reference between a first position defined by said electrically conductive sphere being in contact relation with said first and second contact points and a second position defined by said electrically conductive sphere being in contact relation with said first contact point and in noncontact relation with said second contact point, said common axis is spaced farther from said first contact point than from said second contact point.

2. The tilt switch of claim 1, further comprising:

a source of electrical power; and an electric lamp, said first and second electrically conductive members being connected serially in electrical communication with said source and said lamp.

3. The tilt switch of claim 2, further comprising:

a hood member of a transportation vehicle, wherein said lamp is attached to said hood member.

4. The tilt switch of claim 1, wherein:

said first and second electrically conductive members are generally cylindrical.

5. The tilt switch of claim 4, wherein:

said first and second electrically conductive members are concentric with each other and with said common axis.

6. The tilt switch of claim 1, wherein:

said supporting means comprises a plastic tube connected between said first and second electrically conductive members.

7. The tilt switch of claim 1, further comprising:

said electrically conductive sphere being further movable in response to a second change in position of said common axis relative to said horizontal reference between said first position and a third position defined by said electrically conductive sphere being in contact relation with said second contact point and in noncontact relation with said first contact point.

8. A tilt switch, comprising:

a first generally cylindrical electrically conductive member having a first contact point defined by the intersection of two surfaces of said first electrically conductive member;

a second generally cylindrical electrically conductive member having a second contact point, said first and second electrically conductive members being aligned along a common axis;

means, attached to said first and second electrically conductive members, for supporting said first and second electrically conductive members in nonconducting relation with each other; and an electrically conductive sphere which is disposable in contact with said first and second contact points, said electrically conductive sphere being movable in response to a first change in position of said common axis relative to a horizontal reference between a first position defined by said electrically conductive sphere being in contact relation with said first and second contact points and a second position defined by said electrically conductive sphere being in contact relation with said first contact point and in noncontact relation with said second contact point, said common axis is spaced farther from said first contact point than from said second contact point.

9. The tilt switch of claim 8, further comprising:

a source of electrical power; and an electric lamp, said first and second electrically conductive members being connected serially in electrical communication with said source and said lamp.

10. The tilt switch of claim 9, further comprising:

a hood member of a transportation vehicle, wherein said lamp is attached to said hood member.

11. The tilt switch of claim 8, wherein:

said first and second electrically conductive members are concentric with each other and with said common axis.

12. The tilt switch of claim 8, wherein:

said supporting means comprises a plastic tube connected between said first and second electrically conductive members.

13. The tilt switch of claim 8, further comprising:

said electrically conductive sphere being further movable in response to a second change in position of said common axis relative to said horizontal reference between said first position and a third position defined by said electrically conductive sphere being in contact relation with said second contact point and in noncontact relation with said first contact point.

14. A tilt switch, comprising:

a first electrically conductive member having a first contact point defined by the intersection of two surfaces of said first electrically conductive member;

a second electrically conductive member having a second contact point defined by the intersection of two surfaces of said second electrically conductive member, said first and second electrically conductive members being generally cylindrical and being aligned along a common axis, said first and second electrically conductive members are concentric with each other and with said common axis;

means, attached to said first and second electrically conductive members, for supporting said first and second electrically conductive members in nonconducting relation with each other; and an electrically conductive sphere which is disposable in contact with said first and second contact points, said electrically conductive sphere being movable in response to a first change in position of said common axis relative to a horizontal reference between a first position defined by said electrically conductive sphere being in contact relation with said first and second contact points and a second position defined by said electrically conductive sphere being in contact relation with said first contact point and in noncontact relation with said second contact point, said common axis is spaced farther from said first contact point than from said second contact point.

15. The tilt switch of claim 14, further comprising:

a source of electrical power; and an electric lamp, said first and second electrically conductive members being connected serially in electrical communication with said source and said lamp.

16. The tilt switch of claim 15, further comprising:

a hood member of a transportation vehicle, wherein said lamp is attached to said hood member.

17. The tilt switch of claim 14, wherein:

said supporting means comprises a plastic tube connected between said first and second electrically conductive members.

18. The tilt switch of claim 14, further comprising:

said electrically conductive sphere being further movable in response to a second change in position of said common axis relative to said horizontal reference between said first position and a third position defined by said electrically conductive sphere being in contact relation with said second contact point and in noncontact relation with said first contact point.

* * * * *